US011331545B2

(12) United States Patent
Markison

(10) Patent No.: US 11,331,545 B2
(45) Date of Patent: May 17, 2022

(54) FORCE FOCUSING GOLF CLUB

(71) Applicant: Timothy W. Markison, Mesa, AZ (US)

(72) Inventor: Timothy W. Markison, Mesa, AZ (US)

( * ) Notice: Subject to any disclaimer, the term of this patent is extended or adjusted under 35 U.S.C. 154(b) by 0 days.

(21) Appl. No.: 16/570,548

(22) Filed: Sep. 13, 2019

(65) Prior Publication Data

US 2020/0086185 A1 Mar. 19, 2020

Related U.S. Application Data

(60) Provisional application No. 62/731,605, filed on Sep. 14, 2018.

(51) Int. Cl.
*A63B 53/04* (2015.01)
*A63B 53/08* (2015.01)

(52) U.S. Cl.
CPC ..... *A63B 53/0466* (2013.01); *A63B 53/042* (2020.08); *A63B 53/045* (2020.08); *A63B 53/0408* (2020.08); *A63B 53/0416* (2020.08); *A63B 53/0425* (2020.08); *A63B 53/0429* (2020.08); *A63B 53/0462* (2020.08)

(58) Field of Classification Search
CPC ..... A63B 2053/0416; A63B 2053/042; A63B 2053/0425; A63B 2053/0429; A63B 53/0416; A63B 53/042; A63B 53/0425; A63B 53/0429; A63B 53/0462; A63B 53/08; A63B 53/045
USPC ..... 473/324, 235, 329, 332
See application file for complete search history.

(56) References Cited

U.S. PATENT DOCUMENTS 2,768,919 A 10/1956 Bjorksten
5,431,396 A * 7/1995 Shieh ..... A63B 53/04 473/329
5,766,094 A * 6/1998 Mahaffey ..... A63B 53/04 473/342
5,918,309 A 7/1999 Bachner, Jr.
RE36,950 E * 11/2000 Allen ..... A63B 53/0466 164/34
7,827,897 B2 11/2010 Magnusson
8,621,973 B2 1/2014 Abbe
8,631,592 B2 1/2014 Adair
(Continued)

OTHER PUBLICATIONS

International Searching Authority; International Search Report and Written Opinion; International Application No. PCT/US2017/046992; dated Oct. 30, 2017; 11 pgs.

*Primary Examiner* — John E Simms, Jr.
(74) *Attorney, Agent, or Firm* — Garlick & Markison; Timothy W. Markison

(57) ABSTRACT

A golf club includes a shaft, a grip, and a club head. The shaft is coupled to the grip and to the club head. The club head includes a substantially rigid shell, a club face, and a contact area. The substantially rigid shell includes a conventional shape that has a toe area, a heel area, a sole area, a top area, and a back area. The club face is mechanically coupled to the substantially rigid shell to provide a face of the club head. The contact area is within the substantially rigid shell and positioned proximal to the club face. The contact area includes a plurality of force-focusing layers that functions to concentrate impact forces of the club head towards an area on the club face that makes contact with a golf ball during contact with the golf ball.

15 Claims, 22 Drawing Sheets

(56) References Cited

U.S. PATENT DOCUMENTS 8,707,586 B2 4/2014 Adair
8,938,893 B2 1/2015 Adair
9,022,873 B2 5/2015 Ramirez
9,212,413 B2 12/2015 Wang
9,248,364 B2 2/2016 Ramirez
9,295,300 B2 3/2016 Adair
9,314,060 B2 4/2016 Giles
9,332,799 B1 5/2016 Wenner
9,506,194 B2 11/2016 Schweiger
9,538,798 B2 1/2017 Toronjo
9,545,129 B2 1/2017 Adair
9,586,126 B2 3/2017 Ramirez
9,603,412 B2 3/2017 Adair
9,629,397 B2 4/2017 Toronjo
9,669,283 B2 6/2017 Ramirez
9,717,302 B2 8/2017 Adair
9,738,395 B2 8/2017 Martindale
9,835,429 B2 12/2017 Kerns
9,863,732 B2 1/2018 Curliss
9,936,755 B2 4/2018 Blakely
9,943,746 B2 4/2018 Kennard
9,944,403 B2 4/2018 Park
9,949,518 B2 4/2018 Toronjo
9,961,957 B2 5/2018 Adair
9,975,645 B2 5/2018 Hemingway
9,982,736 B2 5/2018 Greenhill
10,065,101 B2 9/2018 Ramirez
10,092,057 B2 10/2018 Kovarik
10,092,061 B2 10/2018 Adair
10,113,848 B2 10/2018 Germani
10,161,721 B2 12/2018 Roland
10,189,576 B2 1/2019 Martindale
10,195,815 B2 2/2019 Toronjo
10,219,572 B1 3/2019 Whitcomb
2002/0019265 A1* 2/2002 Allen ..... A63B 53/04 473/329
2005/0246824 A1 11/2005 Berger
2008/0076595 A1* 3/2008 Lai ..... A63B 53/04 473/329
2008/0141852 A1 6/2008 Warren
2009/0217812 A1 9/2009 Whitaker
2010/0130303 A1* 5/2010 Stites ..... A63B 53/0466 473/342
2010/0300275 A1 12/2010 Warren
2010/0323812 A1* 12/2010 Boyd ..... A63B 53/0466 473/329
2011/0023693 A1 2/2011 Warren
2011/0059291 A1 3/2011 Boyce
2011/0271824 A1 11/2011 Wahlquist
2011/0281665 A1* 11/2011 Kawaguchi ..... A63B 53/047 473/331
2011/0290104 A1 12/2011 Warren
2012/0090453 A1 4/2012 Cohen
2012/0216668 A9 8/2012 Cohen
2012/0227284 A1 9/2012 Adair
2012/0227285 A1 9/2012 Adair
2012/0266745 A1 10/2012 Warren
2013/0227860 A1 9/2013 Adair
2013/0232819 A1 9/2013 Adair
2013/0291405 A1 11/2013 Adair
2013/0291406 A1 11/2013 Adair
2013/0291407 A1 11/2013 Adair
2013/0298316 A1 11/2013 Jacob
2013/0340150 A1 12/2013 Brantley
2014/0038737 A1* 2/2014 Roach ..... A63B 60/00 473/226
2014/0130378 A1 5/2014 Adair
2014/0208486 A1 7/2014 Krueger
2014/0230285 A1 8/2014 Adair
2014/0323237 A1* 10/2014 Beno ..... A63B 53/0475 473/332
2015/0045141 A1* 2/2015 Myrhum ..... A63B 53/0466 473/329
2015/0072800 A1* 3/2015 Franklin ..... A63B 60/00 473/329
2015/0082663 A1 3/2015 Adair
2015/0082664 A1 3/2015 Adair
2015/0082665 A1 3/2015 Adair
2015/0089837 A1 4/2015 Adair
2015/0089838 A1 4/2015 Adair
2015/0164172 A1 6/2015 Linares
2015/0264991 A1 9/2015 Frey
2015/0327619 A1 11/2015 Leon
2015/0377593 A1 12/2015 Walters
2016/0095362 A1 4/2016 Alomar
2016/0095363 A1 4/2016 Alomar
2016/0263449 A1* 9/2016 Morales ..... A63B 53/04
2018/0049484 A1 2/2018 Markison
2018/0049485 A1 2/2018 Markison
2018/0049503 A1 2/2018 Markison
2018/0049504 A1 2/2018 Markison
2019/0000161 A1 1/2019 Alomar
2019/0029360 A1 1/2019 Adair

* cited by examiner golf club head 10 golf club head 10 golf club head 30 golf club head 10 golf club head 10 golf club head 10 front, top, and side views of 4 layers of defusing cells isometric view of 4 layers of defusing cells layers of rectangular cells golf club head 10 golf club head 10 golf club head 10 golf club head 10 golf club head 10 face view of layers golf club head 10 golf club head 10 golf club head 10 golf club head 10 side view
golf club head 10 golf club head 10

FORCE FOCUSING GOLF CLUB

CROSS REFERENCE TO RELATED PATENTS

The present U.S. Utility patent application claims priority pursuant to 35 U.S.C. § 119(e) to U.S. Provisional Application No. 62/731,605, entitled "Force Focusing Golf Club", filed Sep. 14, 2018, which is hereby incorporated herein by reference in its entirety and made part of the present U.S. Utility patent application for all purposes.

STATEMENT REGARDING FEDERALLY SPONSORED RESEARCH OR DEVELOPMENT

NOT APPLICABLE

INCORPORATION-BY-REFERENCE OF MATERIAL SUBMITTED ON A COMPACT DISC

NOT APPLICABLE

BACKGROUND OF THE INVENTION

Technical Field of the Invention

This invention relates generally to golf and more particularly to golf clubs.

Description of Related Art

Golf clubs are known to include a putter, irons, and woods. Each golf club, whether, putter, iron, or wood, includes a grip, a shaft, and a club head. Each club head includes a face, a back, a sole, a toe, and a heel. The USGA (United States Golf Association) establishes rules for golf clubs that includes size, shape, and length for each type of club.

As an example, current USGA golf club rules include a moment of inertia requirement for woods, which some manufacturers meet by adding weight in the toe and heel of the club head. As another example, the current rules state a club face cannot have a spring effect that exceeds the limits set in the Pendulum Test Protocol.

The USGA rules further include rules regarding the golf ball. For example, the current rules prescribe size, shape and weight requirements for a golf ball. As a further example, the rules for golf balls include a limit on initial velocity and a limit on the overall distance a ball may travel under test conditions. The combination of golf club rules and golf ball rules effect the energy transfer from the club to the ball.

BRIEF DESCRIPTION OF THE SEVERAL VIEWS OF THE DRAWING(S)

DETAILED DESCRIPTION OF THE INVENTION

Figure 1A:
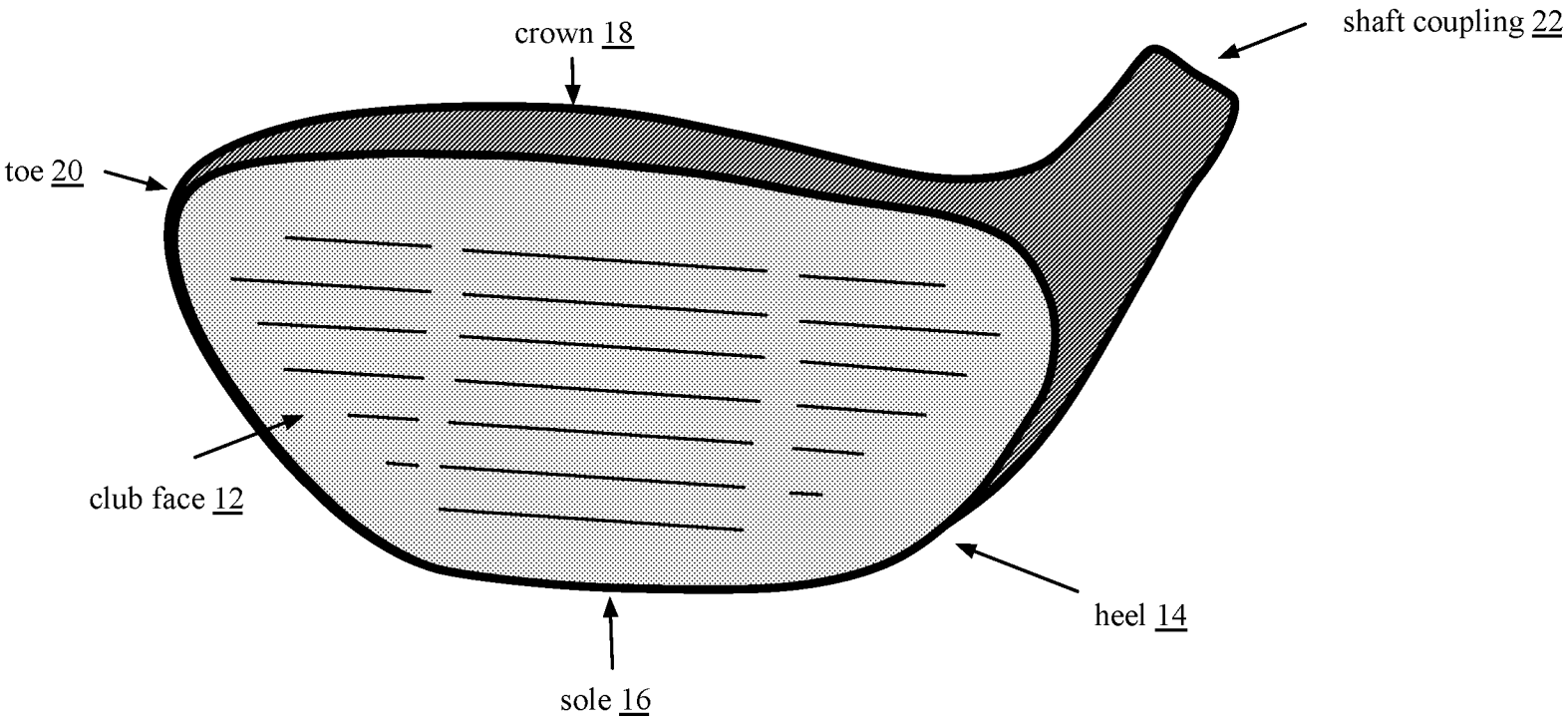
FIG. 1A is a face view diagram of an embodiment of a golf club head in accordance with the present invention.

FIG. 1 is a face view diagram of an embodiment of a golf club head 10, which is part of a golf club that further includes a shaft and a grip. In this embodiment, the golf club head is of a driver (e.g., 1 wood) or of a fairway wood (e.g., 3 wood, 5 wood, etc.). The golf club head 10 includes a club face 12, a heel 14, a sole 16, a crown 18, a toe 20, and a shaft coupling 22. The shaft coupling 22 couples the clubhead 10 to a shaft.

For drivers and fairway woods, the USGA and similar organizations, provide rules and regulations regarding club heads, shafts, and grips. The rules and regulations include club head dimensions. For example, for a driver, the dimension from heel 14 to toe 20 is equal to or less than 5 inches; the sole 16 to crown 18 is equal to or less than 2.8 inches, and the overall volume of the club head 10 is less than or equal to 28.06 cubic inches per the rules in existence at the filing of this application.

The current rules also include rules and regulations regarding performance of a golf club. For example, the rules include a regulation regarding the moment of inertia to limit the amount of twist the club has for off-centered hits. To meet the moment of inertia requirements, many golf clubs have a majority of its weight in the toe 20 and heel 14. As another example, the rules include a regulation regarding the coefficient of restitution (e.g., spring effect) of the club face 12, which is tested using a pendulum test protocol.

Figure 1B:
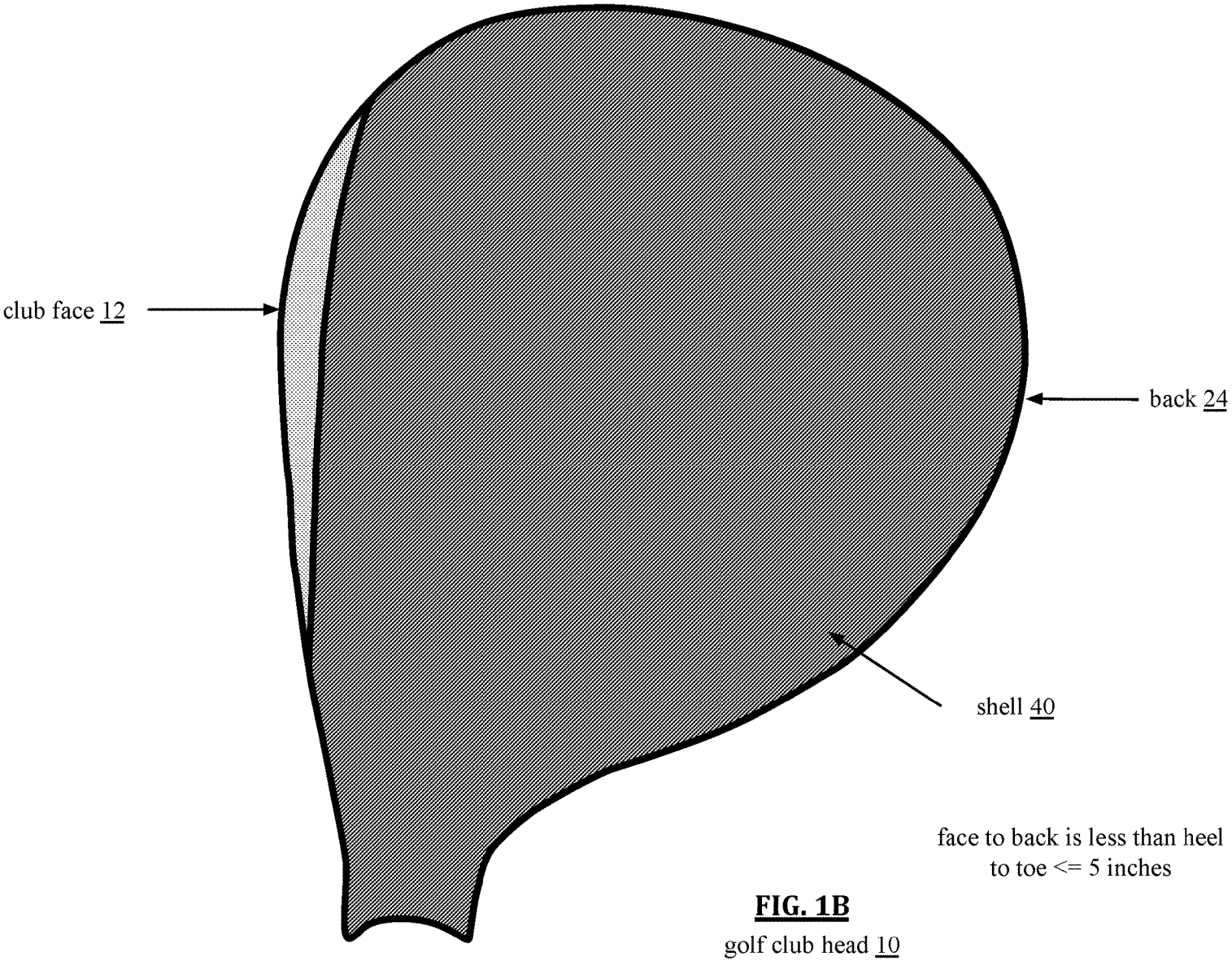
FIG. 1B is a crown view diagram of an embodiment of a golf club head in accordance with the present invention.

FIG. 1B is a crown view diagram of an embodiment of the golf club head 10 shown to include the club face 12, a back 24, and a shell 40. For a driver or fairway wood, the rules and regulations dictate that the distance between the club face 12 and the back 24 is less than the heel 14 to toe 20 distance of five inches or less. The club face 12 is constructed of one or more materials (e.g., titanium, a titanium alloy, stainless steel, aluminum, a metal composition, etc.). The shell 40 is constructed of a substantially rigid material, such as titanium, a titanium alloy, stainless steel, aluminum, a metal composition, etc. The club face 12 is mechanically coupled to the shell 40 in a variety of ways (e.g., welding, press fit, hardware, etc.).

Figure 2:
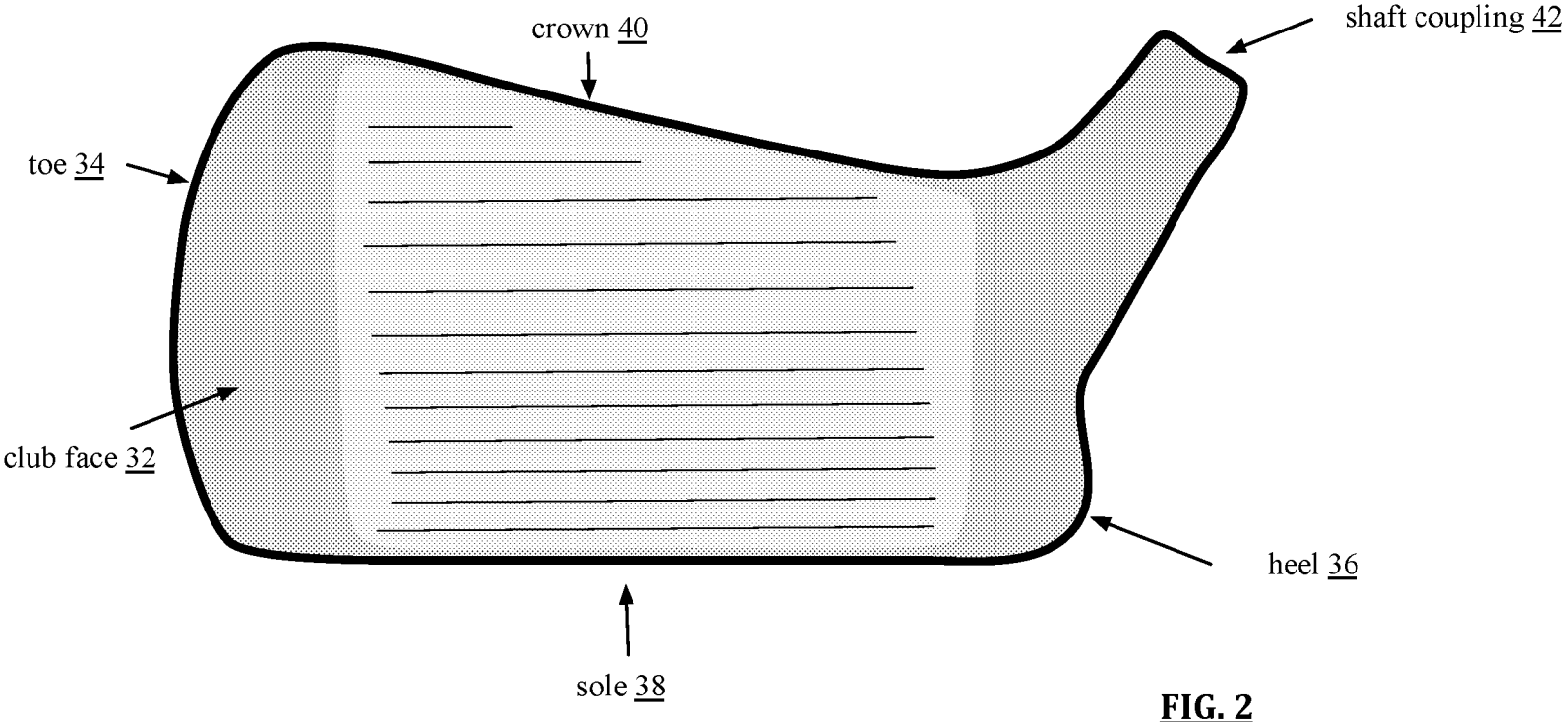
FIG. 2 is a face view diagram of another embodiment of a golf club head in accordance with the present invention.

FIG. 2 is a face view diagram of another embodiment of a golf club head 30, which is part of a golf club that further includes a shaft and a grip. In this embodiment, the golf club head 30 is of a hybrid club or an iron (e.g., wedge, 1-9). The golf club head 30 includes a club face 32, a heel 36, a sole 38, a crown 40, a toe 34, and a shaft coupling 42. The shaft coupling 42 couples the clubhead 30 to a shaft. The golf club head 30 is constructed of one or more materials such as titanium, a titanium alloy, stainless steel, aluminum, a metal composition, etc.

For hybrid clubs or irons, the USGA and similar organizations, provide rules and regulations regarding club heads, shafts, and grips. The rules and regulations include a variety of different requirements, such as impact area markings, grooves, impact area roughness and material, shaft angles and more. For a golf club to be used in USGA sanctioned events, it must be compliant with the rules and regulations. The golf clubs head described herein are designed to be conforming to applicable rules and regulations and the force focusing concepts discussed herein are applicable to drivers, fairway woods, hybrid clubs, and irons. For ease of illustration, a majority of the following discussion of the force focusing concepts is with reference to a driver club head.

Figure 3:
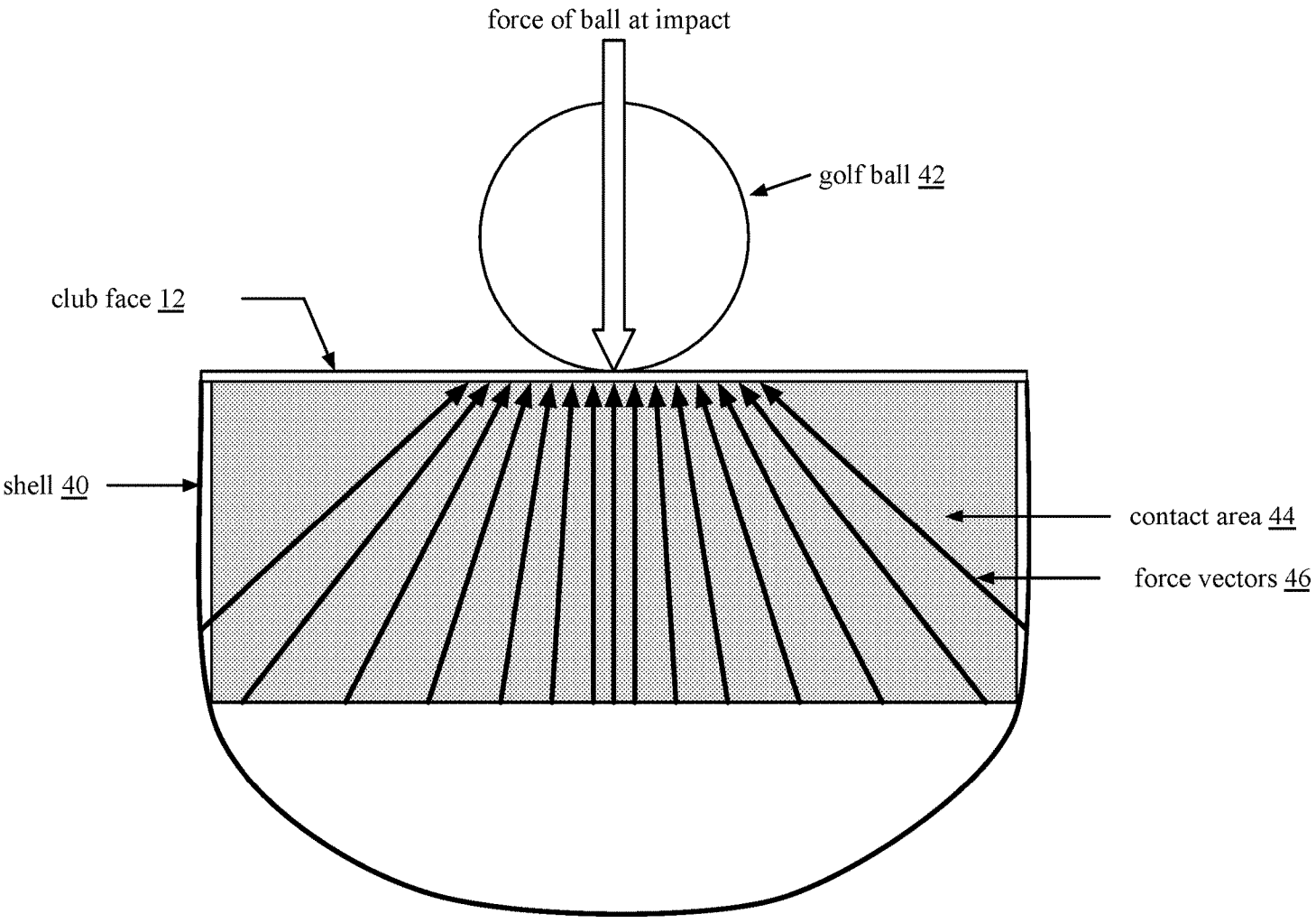
FIG. 3 is a crown view diagram of an embodiment of a golf club head focusing impact force on a golf ball in accordance with the present invention.

FIG. 3 is a crown view diagram of an embodiment of a golf club head 10, which is shown to include the club face 12, the shell 40, and a contact area 44. The contact area 44 focuses the impact forces between the club head 10 and the golf ball 42 towards the point of contact. During contact, there is a transfer of energy from the club head 10 to the ball 42 and it is in accordance with the conservation of momentum. Ignoring losses due to heat, the conservation of momentum as a result of a collision is:

$$m1*v1_0+m2*v2_0=m1*v1_a+m2*v2_a$$

where m1 is the effective mass of the club (e.g., mass of the club plus a portion of the mass of the golfer), m2 is the mass of the ball, $v1_0$ is the initial velocity of the club at impact, $v2_0$ is the velocity of the ball at impact, $v1_a$ is the velocity of the club after impact, and $v2_a$ is the velocity of the ball after impact. since the golf ball is stationary just prior to impact, its velocity is 0. Thus, the equation simplifies to:

$$m1*v1_0=m1*v1_a+m2*v2_a$$

Rewriting the equation, leads to:

$$m1*(v1_0-v1_a)=m1*\Delta v1=m2*v2_a$$

To create the momentum of the club prior to impact $m1*v1_0$, the golfer accelerates the club to create the velocity at impact. The greater the acceleration (which is change in velocity over a time period), the greater the velocity. For example, a professional golfer can produce a 200 mph exit velocity of the ball. With a ball weighing about 1.62 ounces, m2*v2a product is about 20 pound*miles/hour. Thus, m1*Δv1 is also about 20 pound*miles/hour.

With force (F) equally mass (m) times acceleration (a), the equation can be rewritten as:

$$m = F/a$$

Substituting this equation into the $m1*\Delta v1=m2*v2_a$, yields:

$$\frac{F}{a}*\Delta v1 = m2*v2_a$$

Thus, the force (F) created by the club during impact is a direct factor in the exit velocity of the ball. The force (F) is an average value for this equation. During contact, however, the force of a conventional club is distributed across the club face as a force gradient. Thus, less of the potential energy created by the golf club during the swing is converted to kinetic energy to hit the ball. Note that energy (E) is equal to force (F) times distance (d) and that power (P) is energy (E) divided by time (t).

To improve the effective mass of the club, which improves the conversion of potential energy to kinetic energy, the club includes a contact area 44 behind the club face 12. The contact area 44 directs the distributed impact forces (shown as force vectors 46) of the club head 10 towards the ball 42. Thus, more force (F) is exerted on the ball for the same effort of the swing (i.e., same acceleration and same velocities), which results in a greater exit velocity.

Figure 4A:
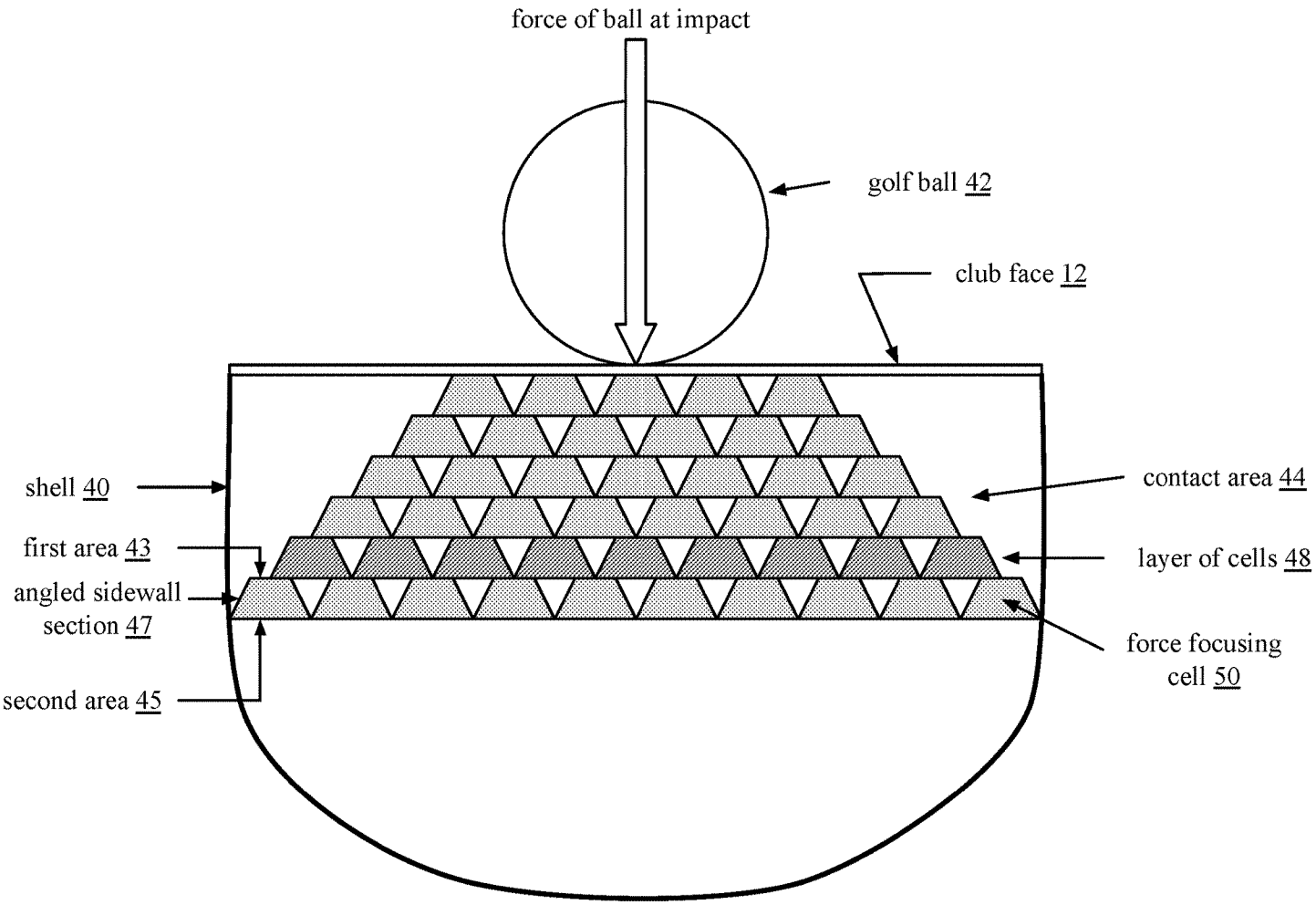
FIG. 4A is a cross-sectional crown view diagram of another embodiment of a golf club head in accordance with the present invention.

FIG. 4A is a cross-sectional crown view diagram of an embodiment of a golf club head 10 that includes the club face 12, the shell 40, and the contact area 44. The contact area 44 includes a plurality of layers 48 of force focusing cells 50. The layers 48 of force focusing cells 50 may be in direct physical contact from layer to layer or they may have a small gap (e.g., less than $1/16^{th}$ of an inch) between layers.

A force focusing cell 50 includes a first area 43, a second area 45, and an angled sidewall section 47 to form a geometric shape (e.g., truncated three-sided pyramid, truncated four-sided pyramid, etc.). A first end of the angled sidewall section 47 is coupled to the first area 43 and another end of the angled sidewall section 47 is coupled to the second area 45. The second area 45 is larger than the first area 43, and, when the club face that makes contact with the golf ball, the force-focusing cell substantially retains the geometric shape. The dimensions of a force focusing cell 50 (e.g., height, width, areas, angles) may varying from ⅛$^{th}$ of an inch to ¾ of an inch or more and the sidewall angle may vary from 30 degrees to 80 degrees.

A variety of embodiments of a force focusing cell 50 is disclosed as a defusing cell in a patent application entitled "BODY IMPACT PROTECTION SYSTEM" having a serial number of Ser. No. 15/676,498, and a filing date of Feb. 22, 2018. One or more of the embodiments of a defusing cell of this patent application may be used for an embodiment of a force focusing cell 50.

The force focusing cells 50 are arranged in layers 48. Five layers are shown, but a club head could include more or less layers (e.g., 2 layers to 10 or more layers). Each layer of force focusing cells may be implemented in a variety of ways. For example, each layer 48 includes a plurality of individual force focusing cells 50 held in place by an aligning grid and the cells are constructed of the same material. As another example, each layer 48 includes a sheet of metal (or other material) in which the cells 50 are formed (e.g., molded, stamped, forged, etc.). As another example, one layer includes a different material for the cells than another layer.

Figure 4B:
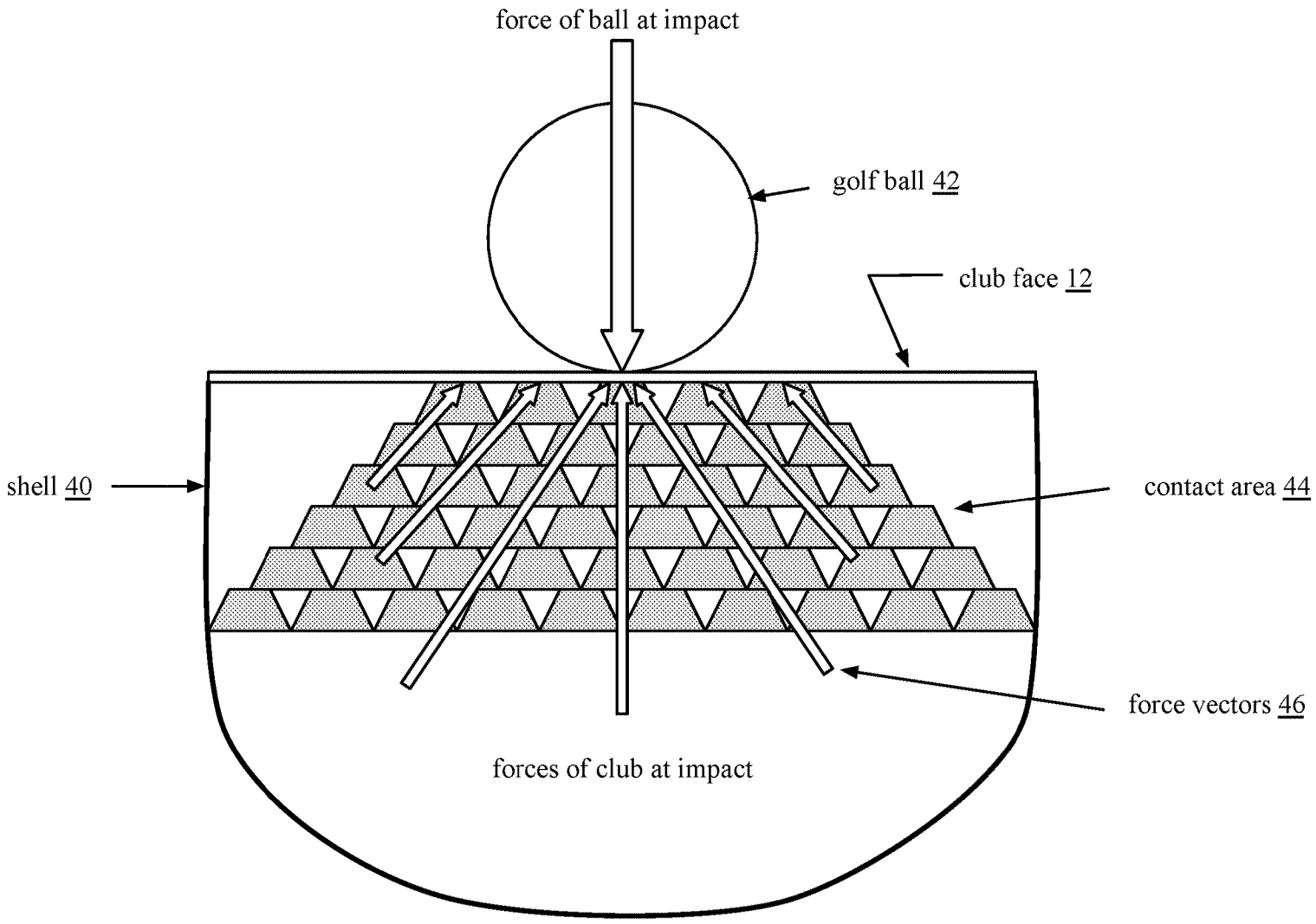
FIG. 4B is a cross-sectional crown view diagram of an embodiment of a golf club head in accordance with the present invention.

During contract between the club head 10 and the ball 42, the force focusing cells focus the impact force components (e.g., force vectors 46) of the club towards the ball as shown in FIG. 4B. The impact force components (e.g., force vectors 46) are the product of the distributed mass of the club times the acceleration of the club. With contact between the layers of force focusing cells, the angular structure of the cells concentrates the impact force components towards the impact area with the ball 42. This increases the force exerted on the ball, which increases the exit velocity of the ball in comparison to the same swing using a conventional golf club.

Figure 5:
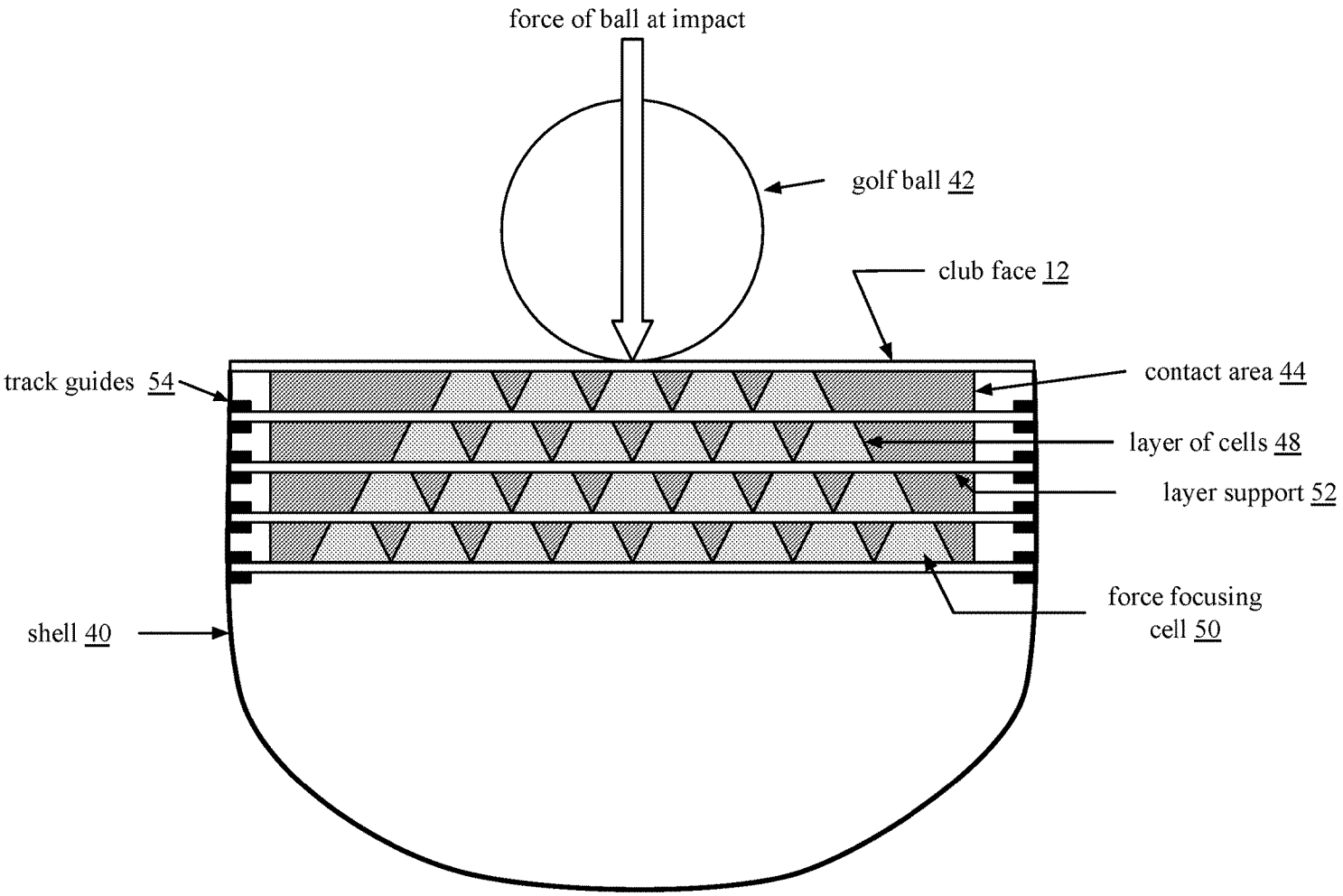
FIG. 5 is a cross-sectional crown view diagram of another embodiment of a golf club head in accordance with the present invention.

FIG. 5 is a cross-sectional crown view diagram of an embodiment of a golf club head 10 that includes the club face 12, the shell 40, and the contact area 44. In this embodiment, the contract area 44 includes a plurality of layers 48 of force focusing cells 50 and one or more layer supports 52. A layer support 52 is held in place by track guides 54, which are mechanically coupled (e.g., welded, etc.) to the shell 40. In an embodiment, a layer support 52 and the track guides 54 are constructed of one or more metals (e.g., titanium, a titanium alloy, stainless steel, aluminum, a metal composition, etc.).

In another embodiment, a layer support 52 for a layer 48 of force focusing cells 50 is formed as part of the layer 48. In this manner, the layer 48 via the layer support 52 is coupled to the shell 40 on a layer by layer basis. As in any embodiment of the contact area 44, it includes at least one layer 48 of force focusing cells.

Figure 6:
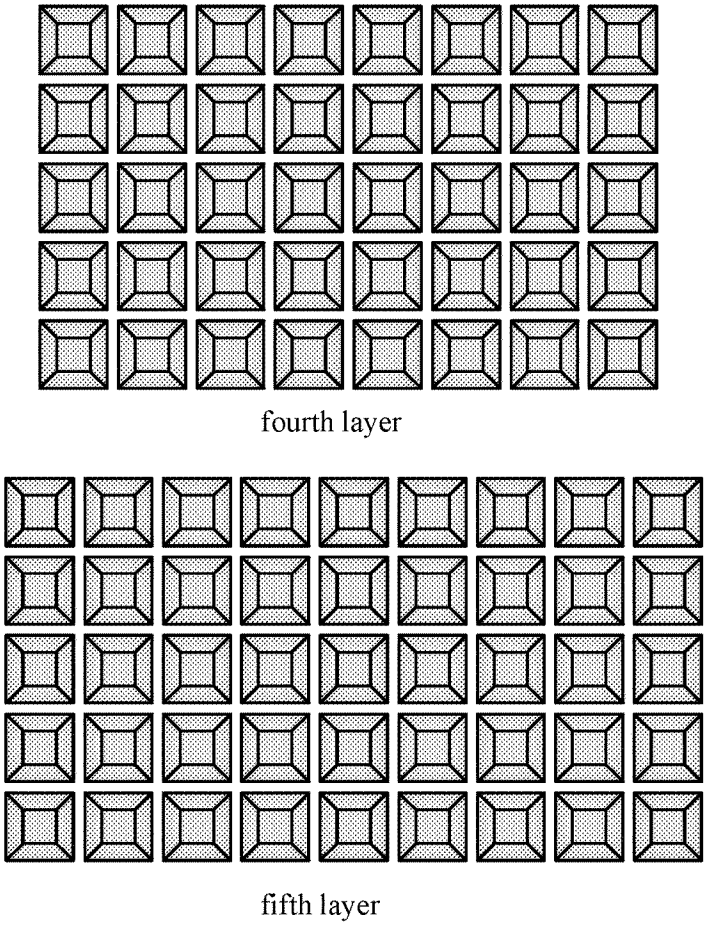
FIG. 6 is a face view diagram of an embodiment of layers of force focusing cells forming a contact area of a golf club head in accordance with the present invention.
Figure 6:
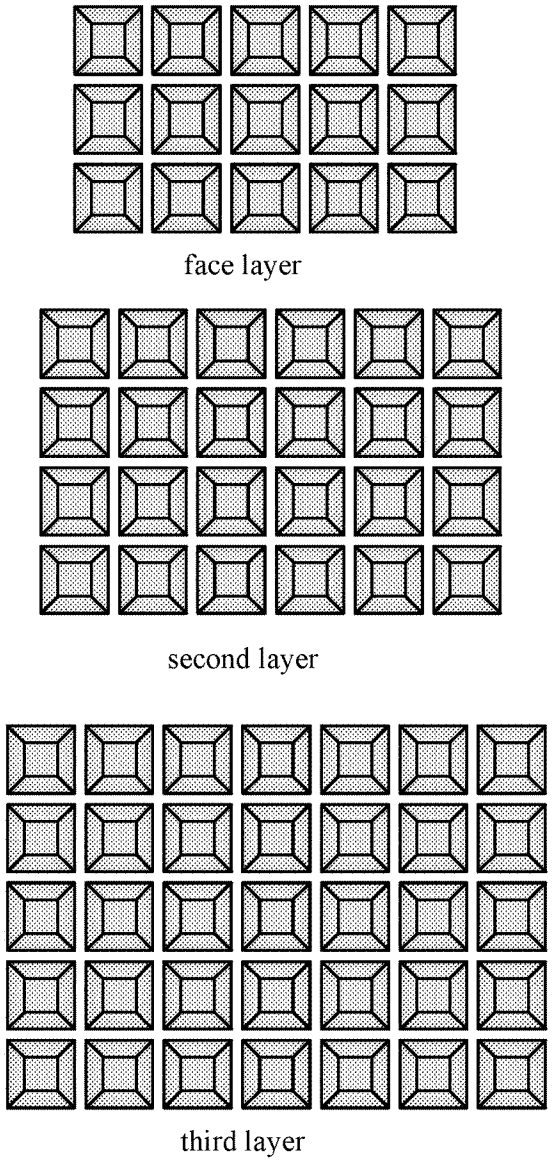

FIG. 6 is a face view diagram of an embodiment of five layers of force focusing cells forming a contact area 44 of a golf club head 10. The face layer is adjacent to the club face 12. The second layer is adjacent to the face layer, with a cell near the middle of the face layer overlapping four cells of the second layer. The third layer is adjacent to the second layer, with a cell near the middle of the second layer overlapping four cells of the third layer. The fourth layer is adjacent to the third layer, with a cell near the middle of the third layer overlapping four cells of the fourth layer. The fifth layer is adjacent to the fourth layer, with a cell near the middle of the fourth layer overlapping four cells of the fifth layer.

Figure 7:
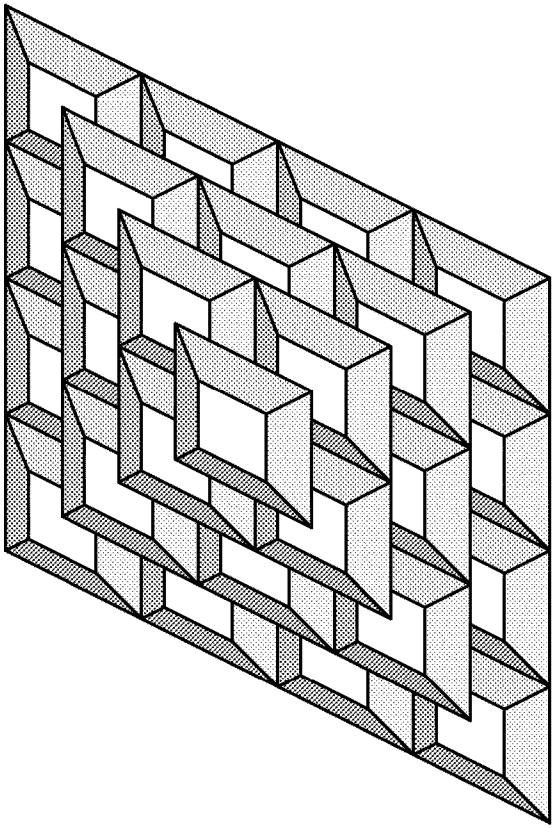
FIG. 7 is an isometric view diagram of an embodiment of four layers of force focusing cells of a contact area of a golf club head in accordance with the present invention.

FIG. 7 is an isometric view diagram of an embodiment of four layers 48 of force focusing cells 50 of a contact area 44 of a golf club head 10. With four layers, the sixteen cells of the fourth layer collide with the nine cells of the third layer. The nine cells of the third layer collide with the four cells of the second layer, which collides with the one cell of the first layer. As such, the resulting impact force on the ball is the concentrated forces of sixteen cells, to nine cells, to four cells, to once cell, which, in this example, makes contact with the ball.

Figure 8:
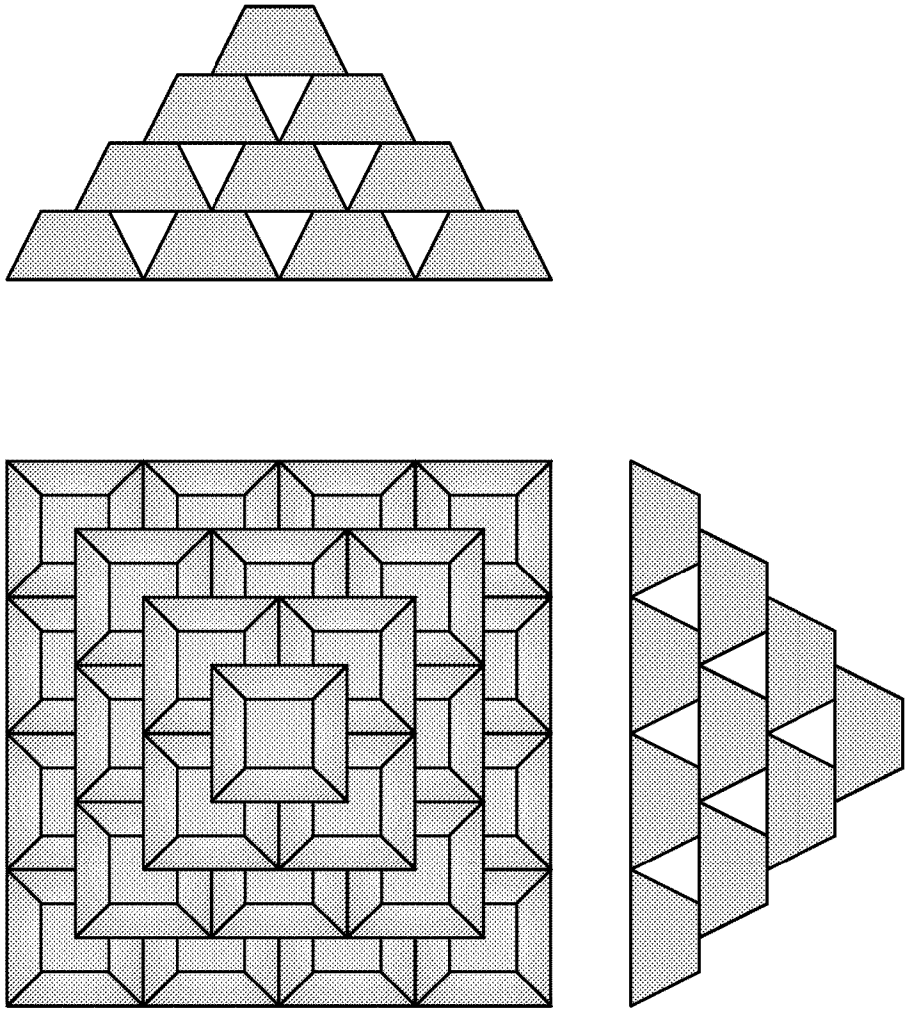
FIG. 8 is a front, top, and side view diagrams of an embodiment of four layers of force focusing cells of a contact area of a golf club head in accordance with the present invention.

FIG. 8 is a front, top, and side view diagrams of an embodiment of the four layers of force focusing cells of FIG. 7. This is example illustrates how a cell on one layer interacts with up to four cells on the layer below it.

Figure 9:
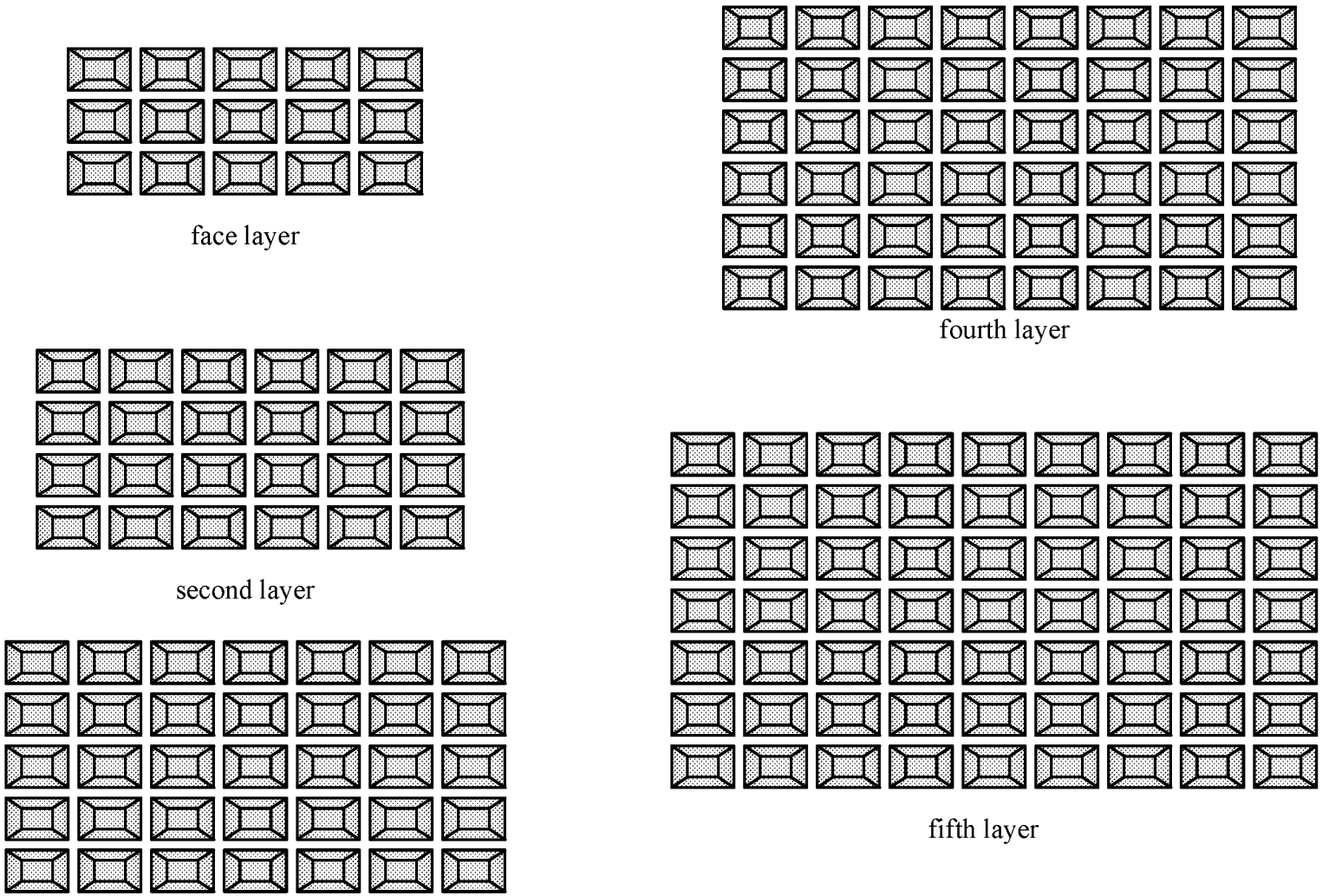
FIG. 9 is a face view diagram of an embodiment of layers of force focusing cells forming a contact area of a golf club head in accordance with the present invention.

FIG. 9 is a face view diagram of an embodiment of layers of rectangular force focusing cells forming a contact area of a golf club head. As with the example of FIG. 6, the layers are adjacent to each other such that a cell from one layer interacts with up to four cells of the layer below it.

Figure 10A:
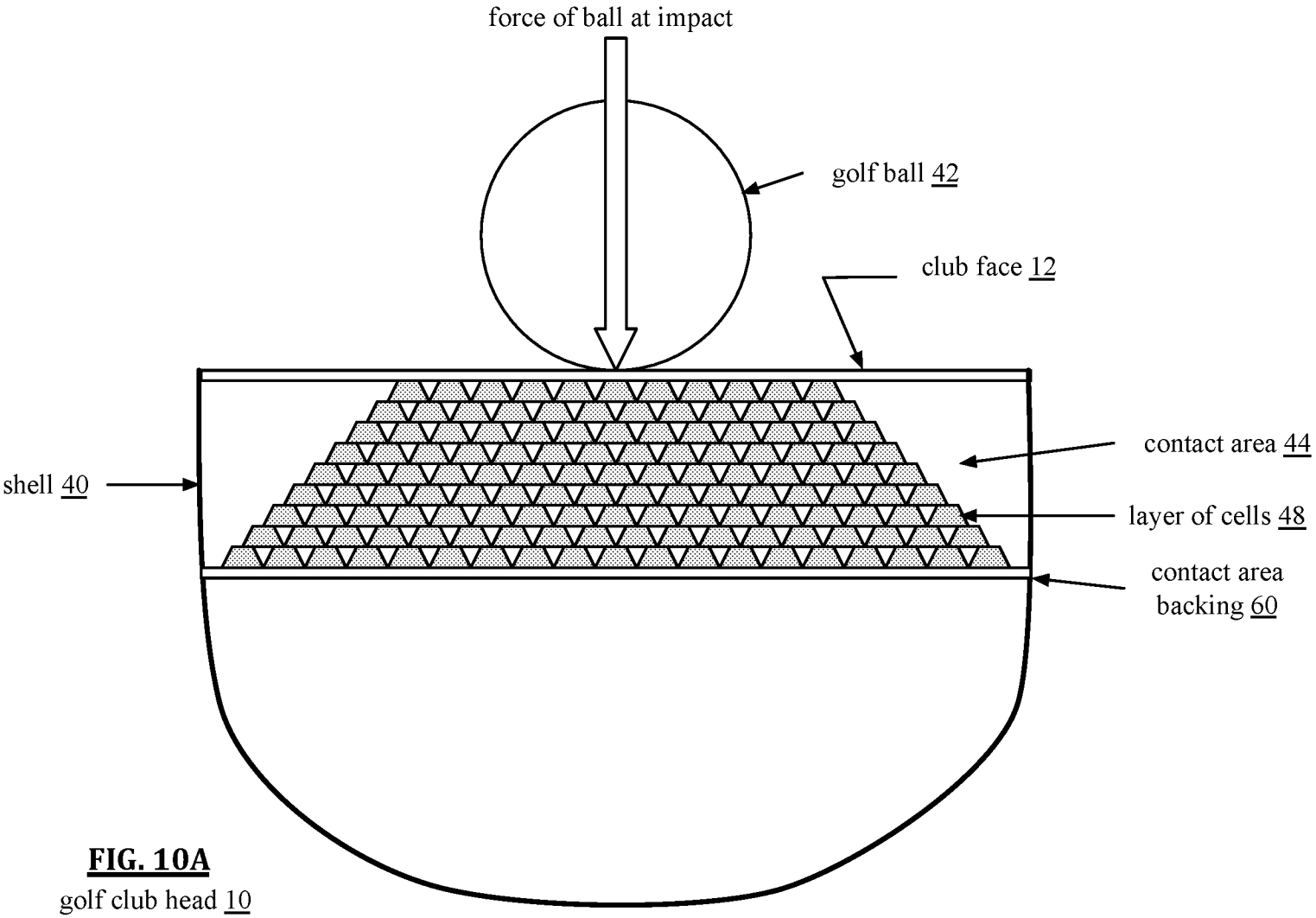
FIG. 10A is a cross-sectional crown view diagram of another embodiment of a golf club head in accordance with the present invention.

FIG. 10A is a cross-sectional crown view diagram of another embodiment of a golf club head 10 that includes the club face 12, the shell 40, the contact area 44, and a contract area backing 60. In this embodiment, the contract area 44 includes a plurality of layers 48 of force focusing cells 50. In comparison with previous figures, the force focusing cells 50 are smaller and there are more layers 48. Smaller cells 50 and more layers 48 allows for more even force concentration on the club face 12. As such, for a player that has an inconsistent club face to ball contact area, the forces are still focused towards the point of contact, but a smaller force focusing level than with larger cells. Further, for a player that has a relatively consistent club face to ball contact area, larger cells with fewer layers can provide a greater focusing of forces.

The contact area backing 60 is mechanically coupled (e.g., welded, track guides, hardware, etc.) to the shell 40. In an embodiment, the contact area backing 60 is constructed of one or more metals (e.g., titanium, a titanium alloy, stainless steel, aluminum, a metal composition, etc.). The contact area backing 60 functions to hold the plurality of layers in place and to provide a rigid surface for focusing the forces of the layers of cells.

As is further shown in this example embodiment, the face layer of the plurality of layers of cells is behind the club face 12. As such, the focused forces of the layers are transferred to the club face 12, which impacts with the ball 42.

Figure 10B:
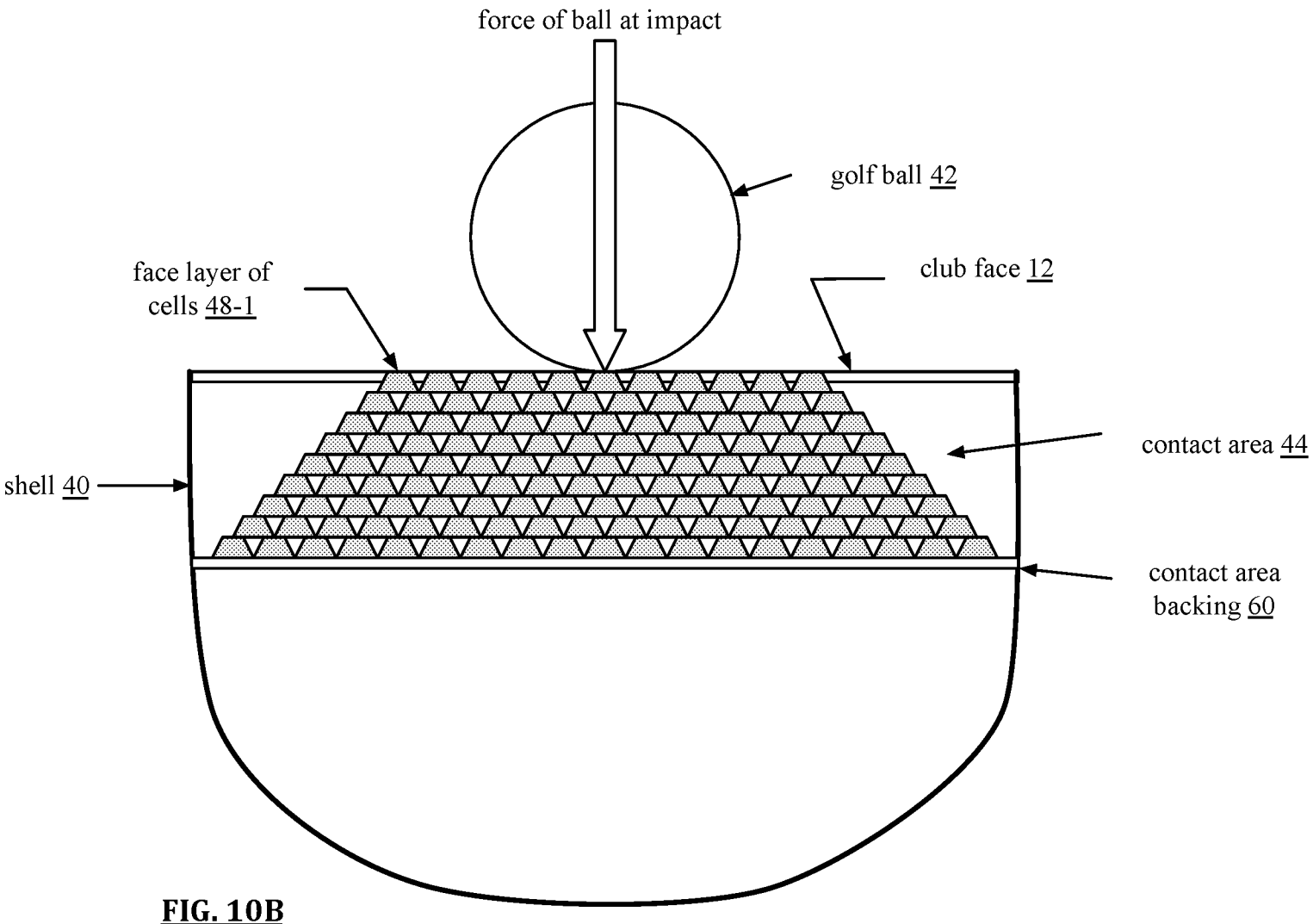
FIG. 10B is a cross-sectional crown view diagram of another embodiment of a golf club head in accordance with the present invention.

FIG. 10B is a cross-sectional crown view diagram of another embodiment of a golf club head 10 that includes the club face 12, the shell 40, the contact area 44, and a contract area backing 60. This embodiment is similar to the embodiment of FIG. 10A with a difference being, in this embodiment, the face layer of cells 48-1 is integrated into the club face 12. As such, the face layer 48-1 and the club face 12 make contact with the ball 42.

There is a variety of ways in which the face layer 48-1 can be integrated into the club face 12. For example, the club face 12 includes openings in which the tip of the cells of the face layer 48-1 fit. In another example, the club face 12 is formed (e.g., molded forged, etc.) to include the face layer 12.

Figure 11:
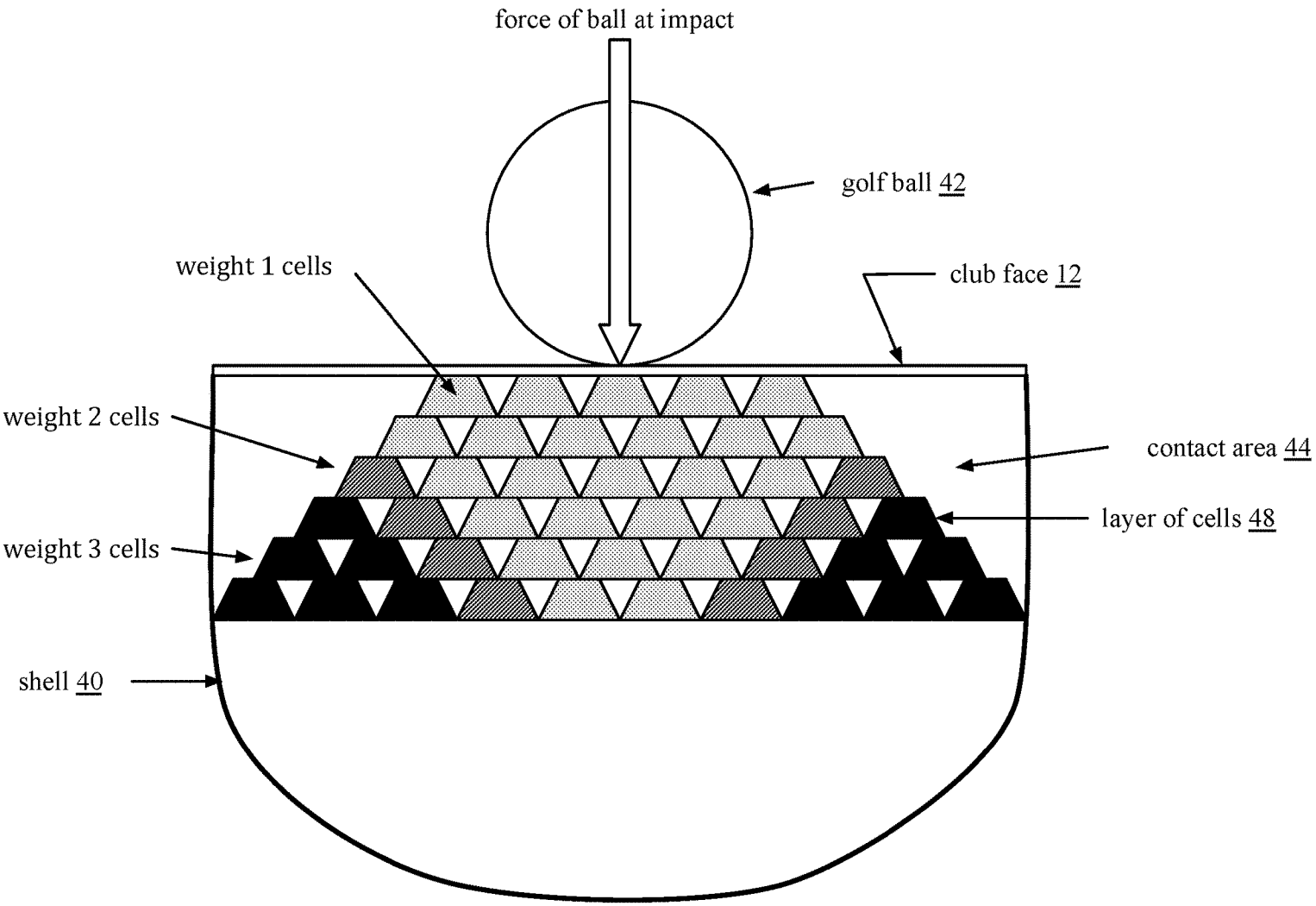
FIG. 11 is a cross-sectional crown view diagram of another embodiment of a golf club head in accordance with the present invention.

FIG. 11 is a cross-sectional crown view diagram of another embodiment of a golf club head 10 that includes the club face 12, the shell 40, and the plurality of layers 48 of force focusing cells. In this embodiment, the cells are of different weight. For instance, the darker shaded force focusing cells weight more than the lighter shaded cells. For example, if the club head 10 weighs between 350 grams, the shell weights 125 grams, the club face 12 weighs 75 grams, then there are 150 grams for the layers of cells. For this example, assume four layers of cells, with the face layer including 26 cells, the second layer including 35 cells, the third layer including 45 cells, and the fourth layer including 51 cells (e.g., first four layers of FIG. 14).

Further assume that the face layer only includes the first weighted cells, the second layer includes first and second weighted cells, and the third and fourth layers includes first, second, and third weighted cells. Further assume that the first layer has a weight of 22.5 grams, the second layer has a weight of 30 grams, the third layer has a weight of 45 grams, and the fourth layer has a weight of 52.5 grams. As such, each cell in the first layer weighs approximately 0.86 grams; thus, each cell of the first weight weighs 0.86 grams. Cells of the second weight may weigh 1.15 grams and cells of the third weight may weigh 1.5

In this manner, more weight is in the heel and the toe of the club head. This helps address the moment of inertia requirements of a club. Further, the club still receives the benefits of focusing forces to the point of contact between the ball 42 and the club head 10.

Figure 12:
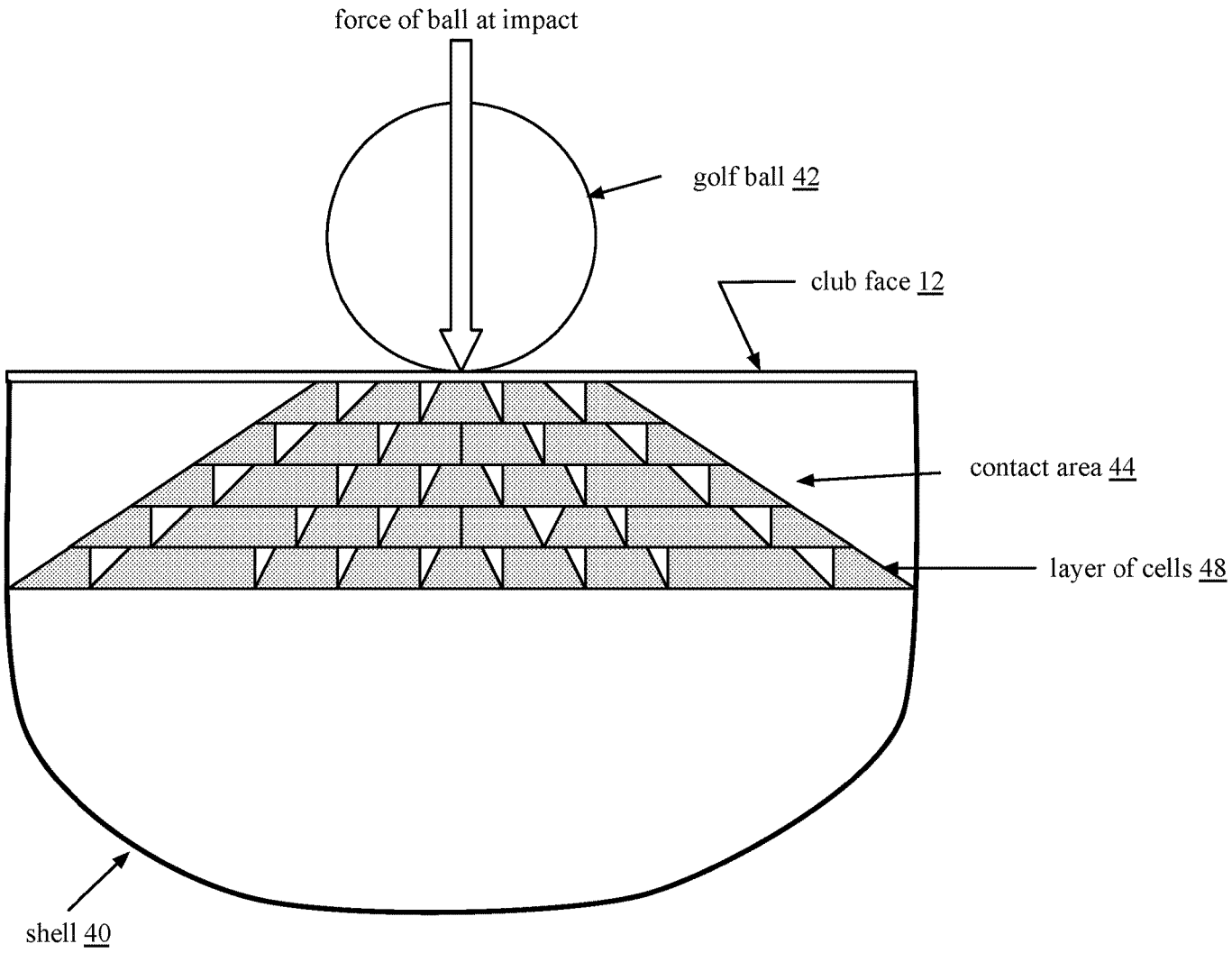
FIG. 12 is a cross-sectional crown view diagram of another embodiment of a golf club head in accordance with the present invention.
Figure 13:
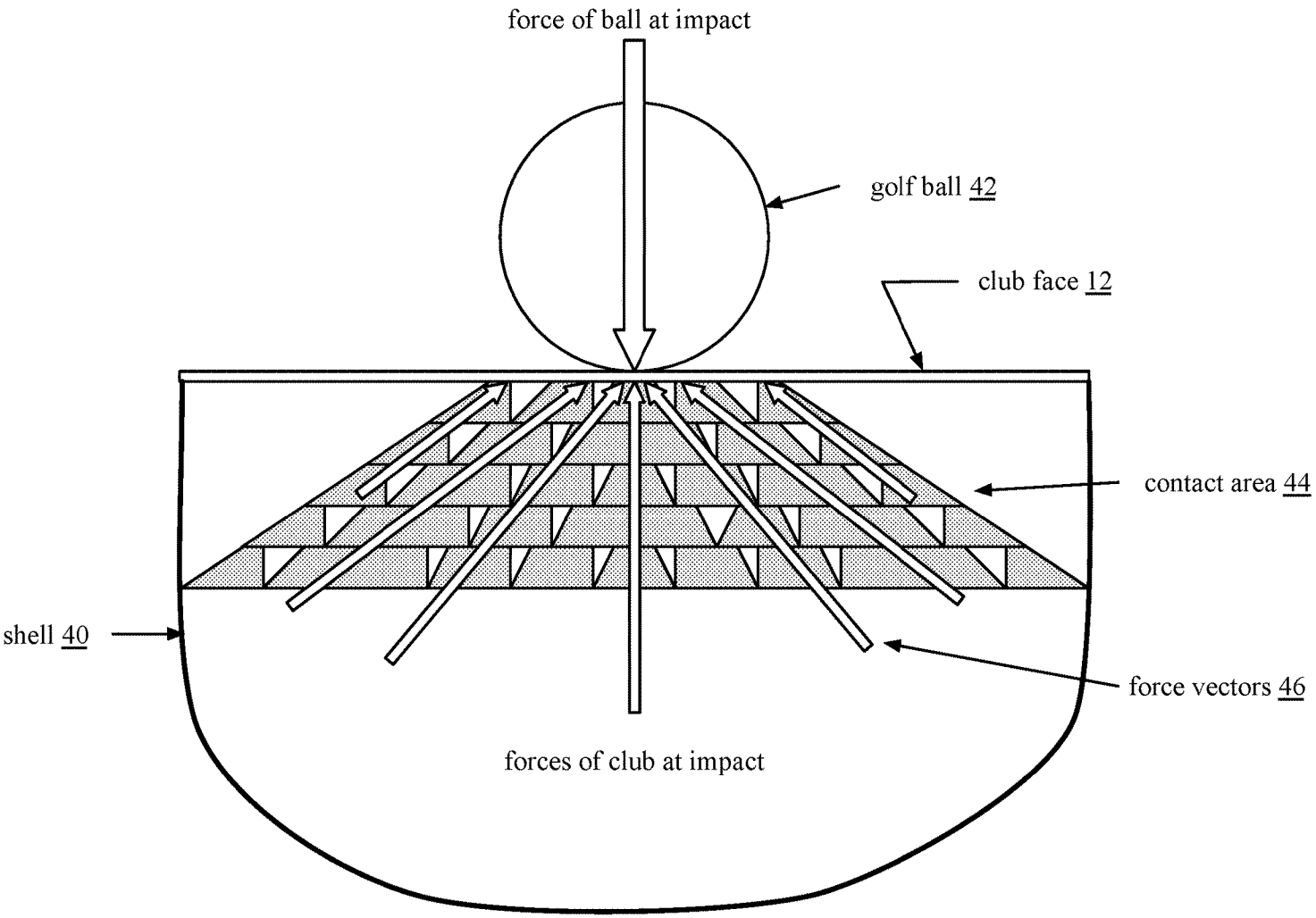
FIG. 13 is a crown view diagram of another embodiment of a golf club head focuses impact force on a golf ball in accordance with the present invention.

FIG. 12 is a cross-sectional crown view diagram of another embodiment of a golf club head 10 that includes the club face 12, the shell 40, the contact area 44. The contact area 44 includes a plurality of layers 48 of force focusing cells. In this embodiment, some of the cells have an asymmetrical shape and/or are of a different size to provide more focusing of the forces at the perimeters of the layers. An asymmetrical shape has a larger angle for the sidewall on the outer edge of the cell than on the inner edge of the cell. The asymmetrical cells change the angle of the force vectors that are further away from the point of contact to provide more force to the point of contact. An example of this is shown in FIG. 13.

Figure 14:
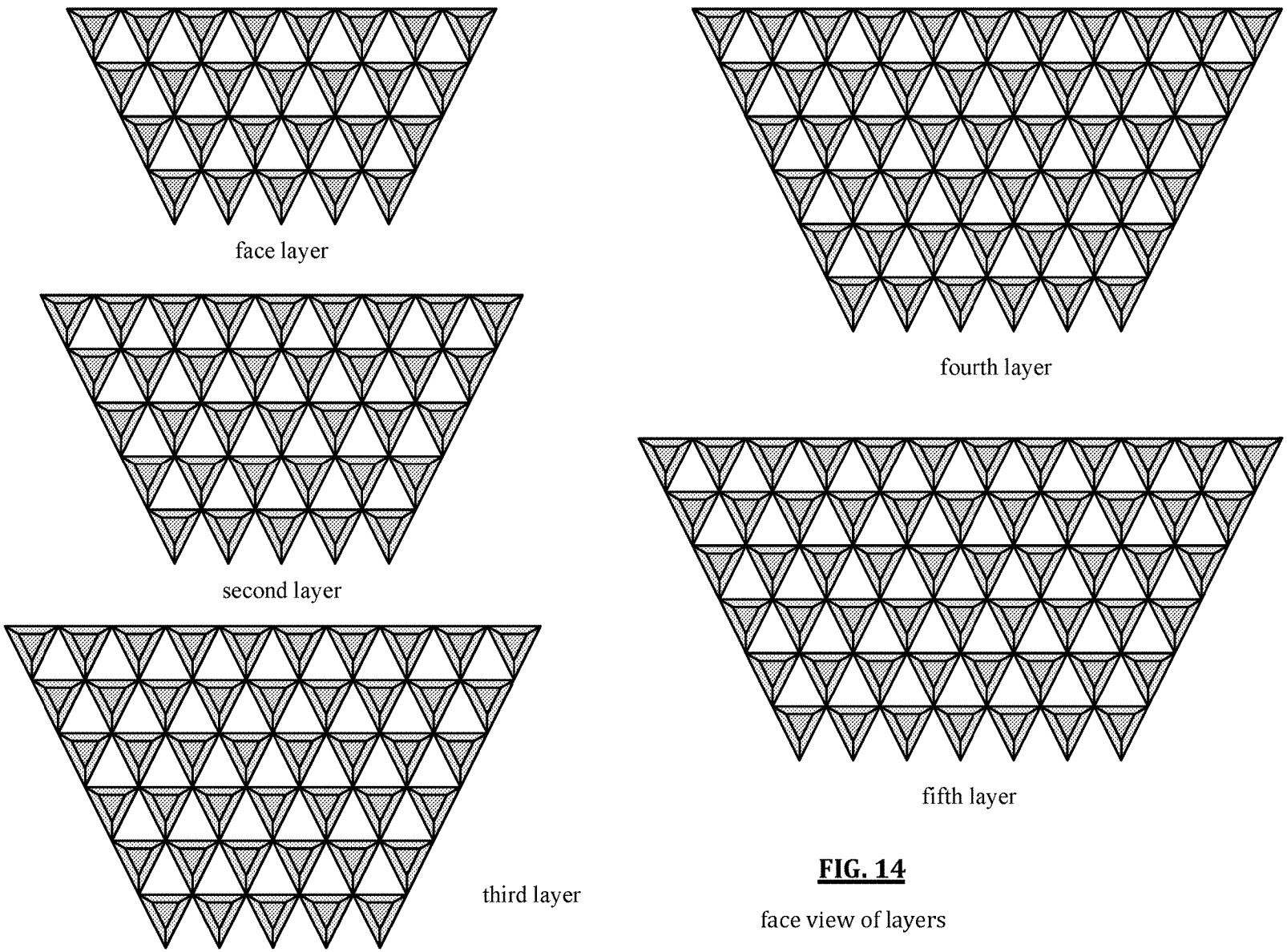
FIG. 14 is a face view diagram of another embodiment of layers of force focusing cells forming a contact area of a golf club head in accordance with the present invention.
Figure 15:
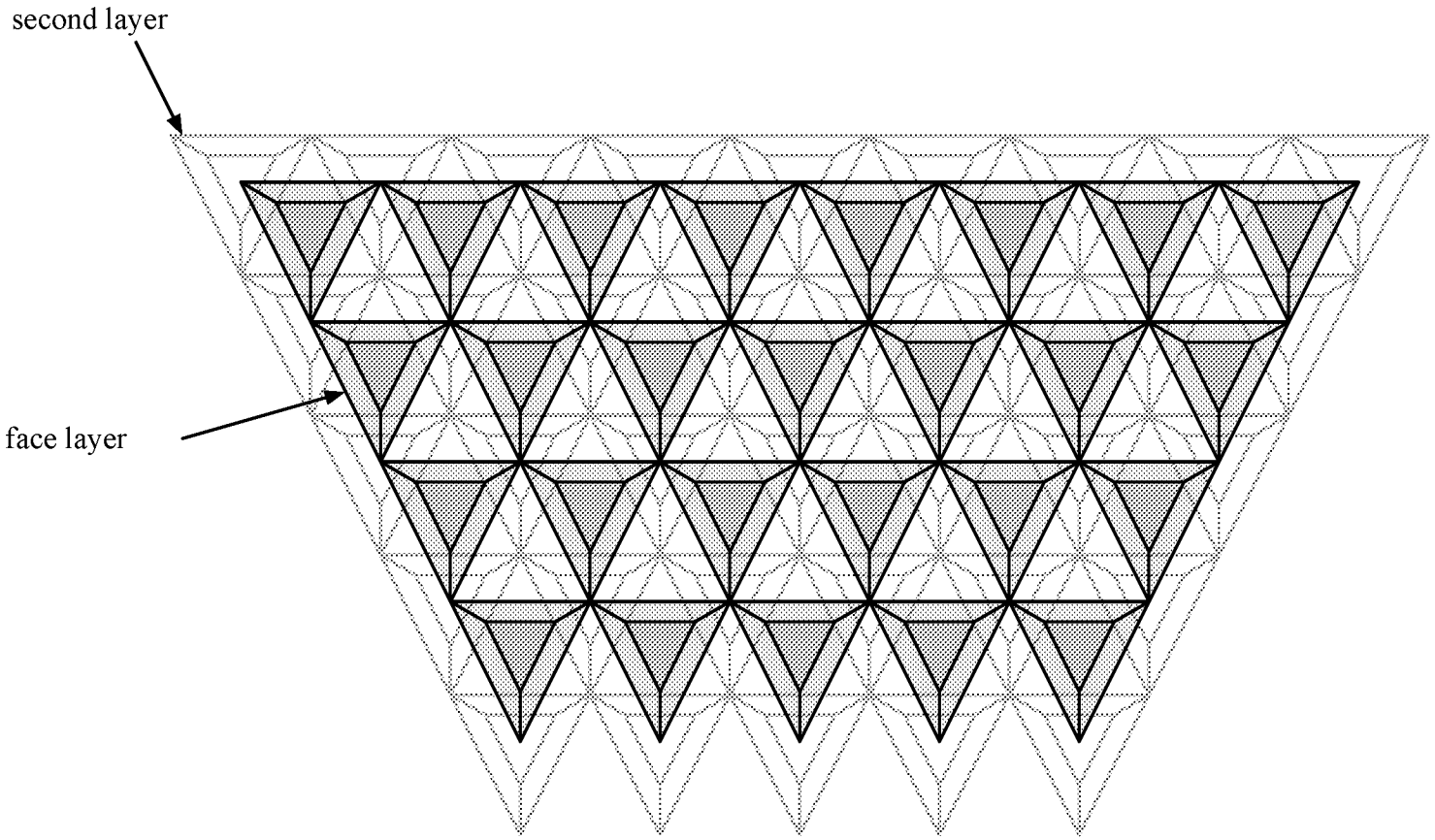
FIG. 15 is a face view diagram of an embodiment of face layer of force focusing cells positioned with respect to a second layer of force focusing cells of a contact area of a golf club head in accordance with the present invention.

FIG. 14 is a face view diagram of another embodiment of layers of triangular force focusing cells forming a contact area of a golf club head. In an embodiment, each layer includes triangular voids, which is represented by the white shaded triangles. In another embodiment, there are no voids. The first two layers of triangular cells are stack as shown in FIG. 15. In this example, the corners of a cells of the face layer touches three cells on the second layer and is approximately in the center of the three cells of the second layer.

Figure 16A:
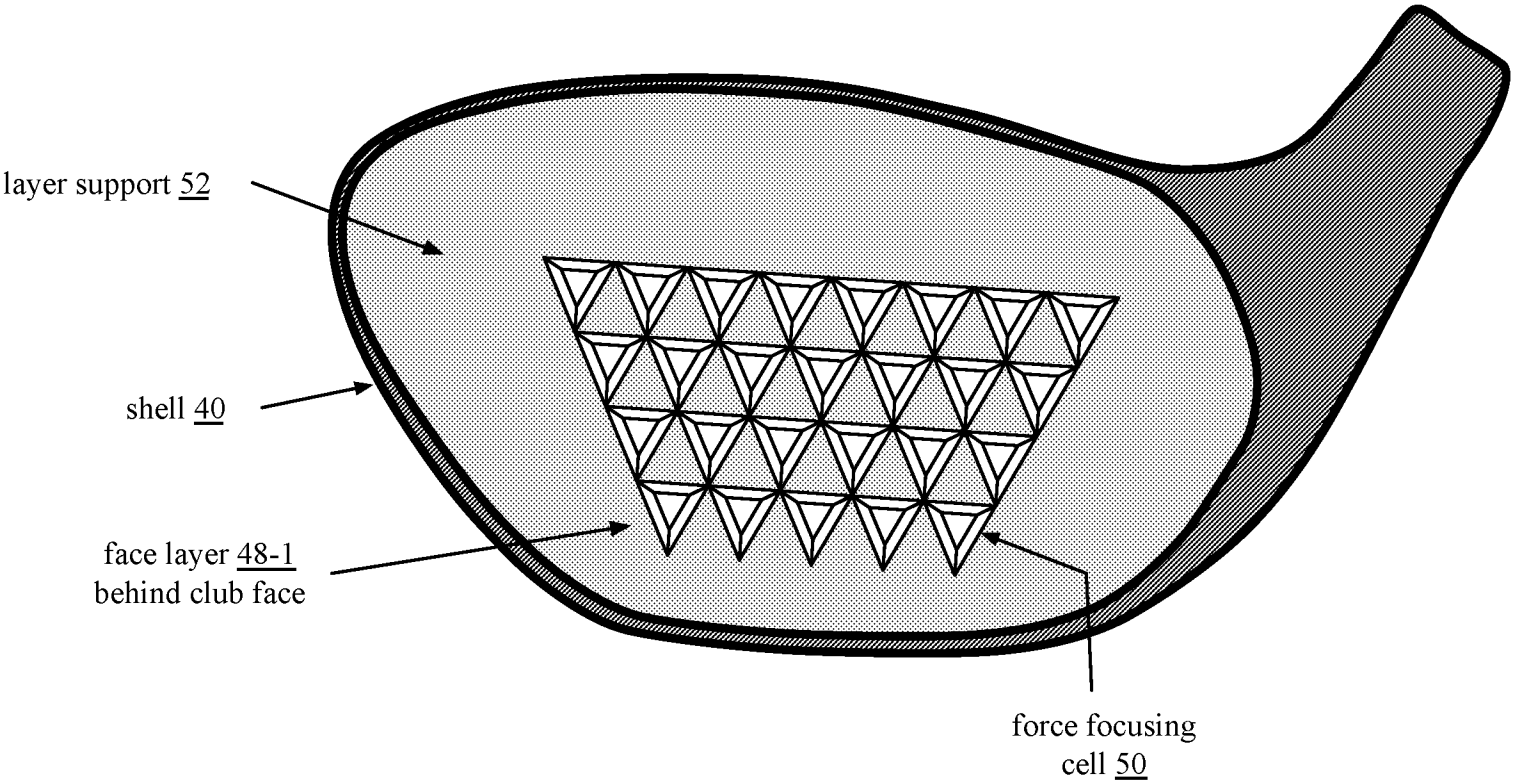
FIG. 16A is a face view diagram of an embodiment of face layer of force focusing cells positioned on a mounting sheet of a contact area of a golf club head in accordance with the present invention.

FIG. 16A is a face view diagram of an embodiment of a golf club head 10 with the club face 12 removed to show the face layer 48-1. In this embodiment, the face layer 48-1 is mounted on or integrated into a layer support 52. The cells 50 of the layer are positioned in the primary contact area of the club head.

Figure 16B:
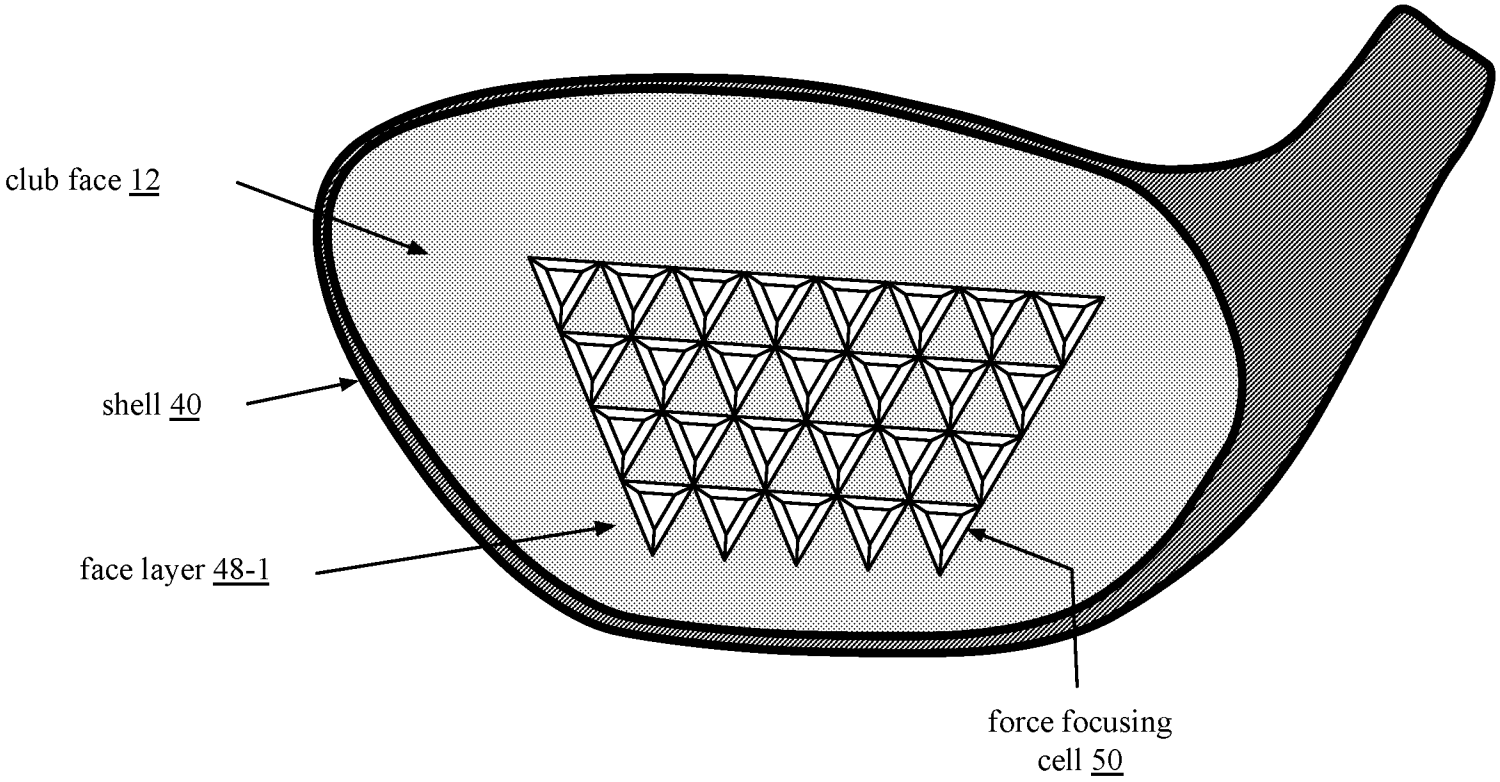
FIG. 16B is a face view diagram of an embodiment of face layer of force focusing cells integrated into a face plate of a golf club head in accordance with the present invention.

FIG. 16B is a face view diagram of an embodiment of a golf club head 10 with the club face 12 removed to show the face layer 48-1. This embodiment is similar to the embodiment of FIG. 16A with a difference being that the face layer 48-1 is in the club face 12. As such, the tips of the cells 50 are on plane with the club face 12 to make contact with the ball.

Figure 17:
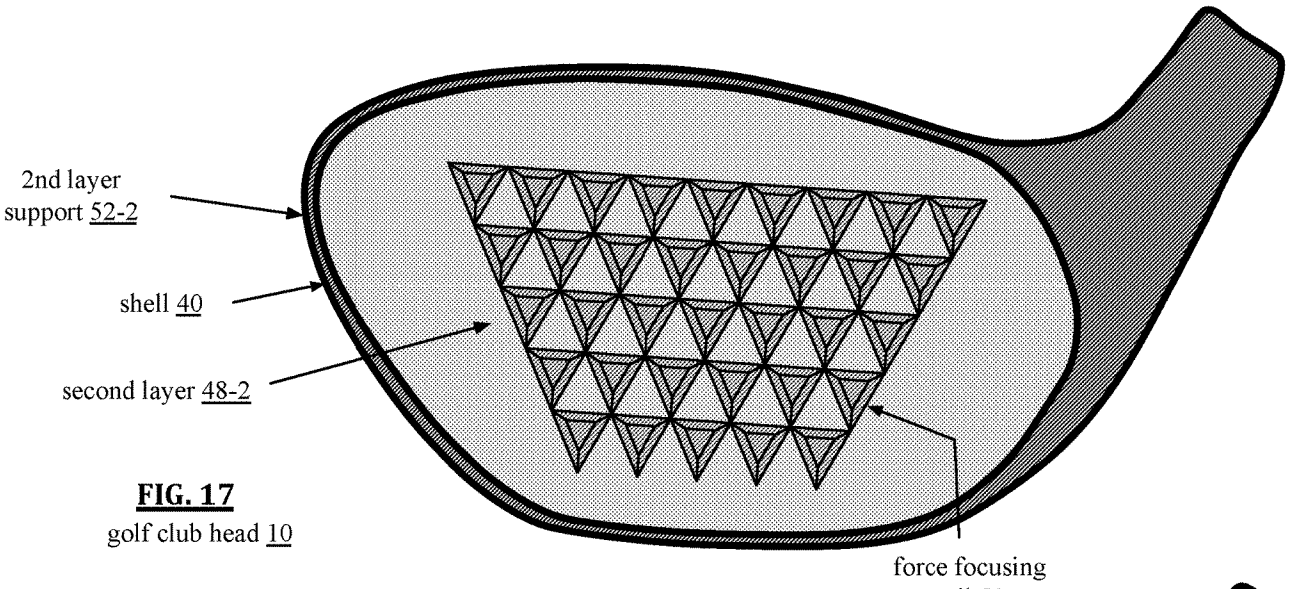
FIG. 17 is a face view diagram of an embodiment of a second layer of force focusing cells positioned on a mounting sheet of a contact area of a golf club head in accordance with the present invention.

FIG. 17 is a face view diagram of an embodiment of a second layer 48-2 of force focusing cells positioned on a second layer support 52-2 of a contact area of a club head 10. The second layer 48-2 of cells 50 is positioned behind the face layer 48-1 of either embodiment of FIG. 16A or 16B.

Figure 18:
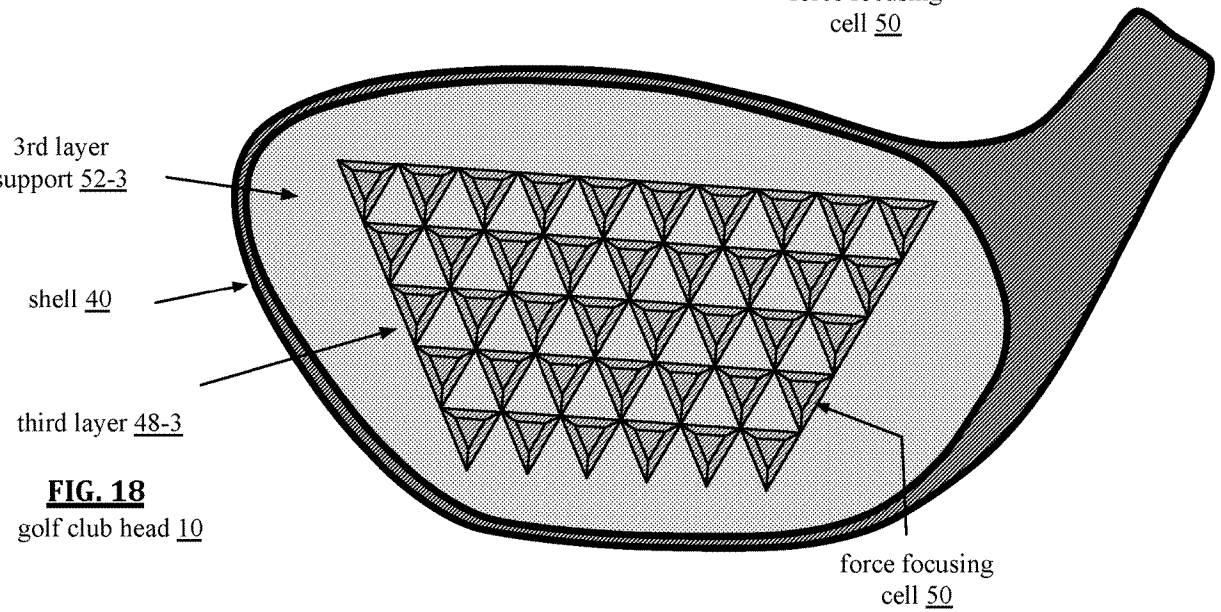
FIG. 18 is a face view diagram of an embodiment of a second layer of force focusing cells positioned on a mounting sheet of a contact area of a golf club head in accordance with the present invention.

FIG. 18 is a face view diagram of an embodiment of a third layer 48-3 of force focusing cells positioned on a third layer support 52-3 of a contact area of a club head 10. The third layer 48-3 of cells 50 is positioned behind the second layer 48-2 of FIG. 17. IF the club head includes additional layers, they would be a similarly mount on a layer support 52 and placed behind the preceding layer.

Figure 19:
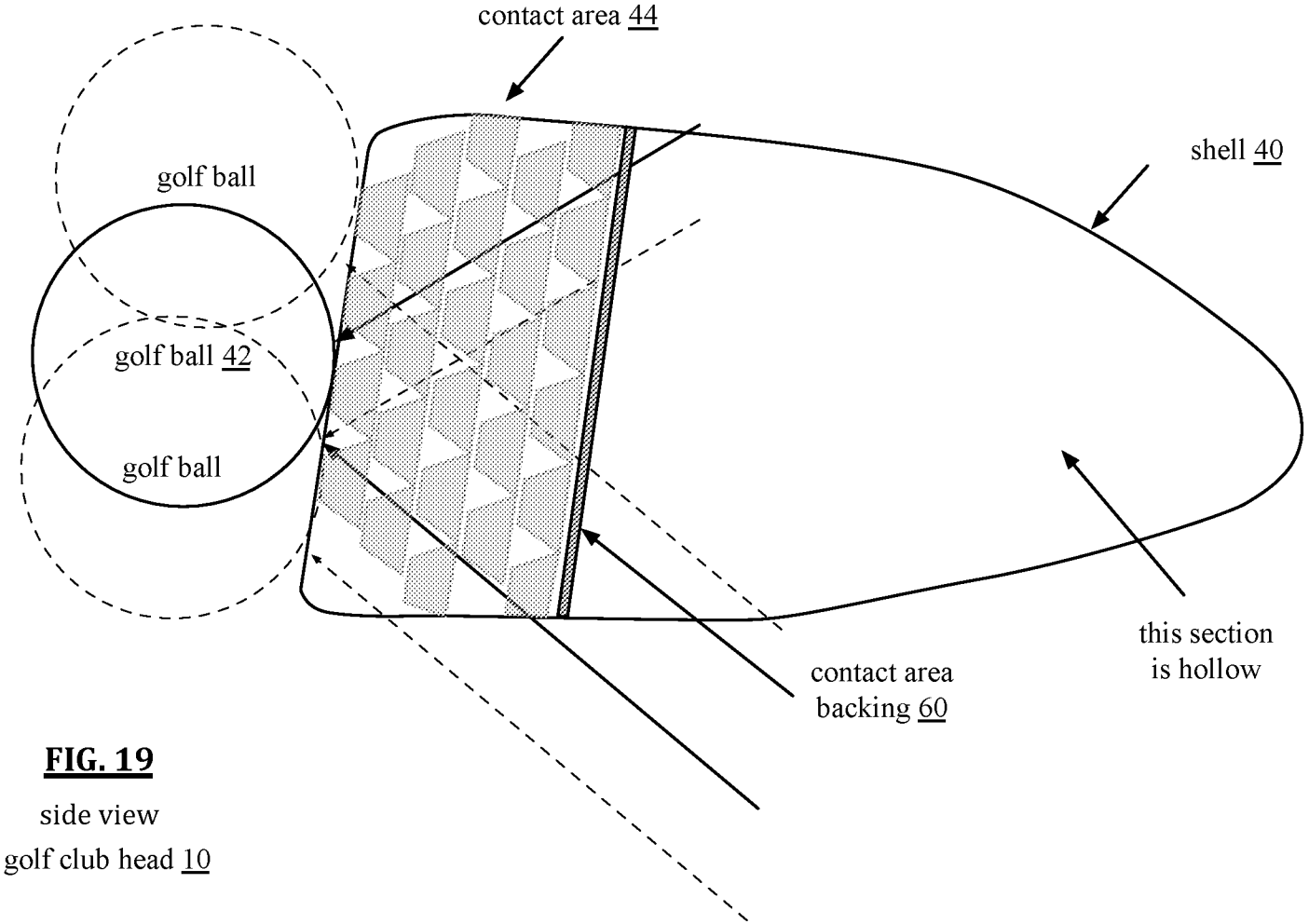
FIG. 19 is a side view diagram of an embodiment of layers of force focusing cells positioned in a contact area of a golf club head in accordance with the present invention.

FIG. 19 is a side view diagram of an embodiment of a golf club head 10 that includes the contact area 44, the club face 12, the shell 40, and the contact area backing 60. The contact area 44 includes a plurality of layers of force focusing cells that are supported by the contact area backing 60. The portion of the shell 40 behind the contact area backing 60 is hollow.

In this example, various contact points of the ball 42 and club face are shown. When the contact point is in the middle of the face (i.e., the ball 42 shown with solid lines), the forces are best focused to provide the most energy transfer to the ball. When the contact point is off center (i.e., the ball 42 is shown with dashed lines) only a portion of the cells are focusing forces to the ball. This still provides a force focusing benefit, but not as much as when the contact point is in the middle of the face 12.

Figure 20:
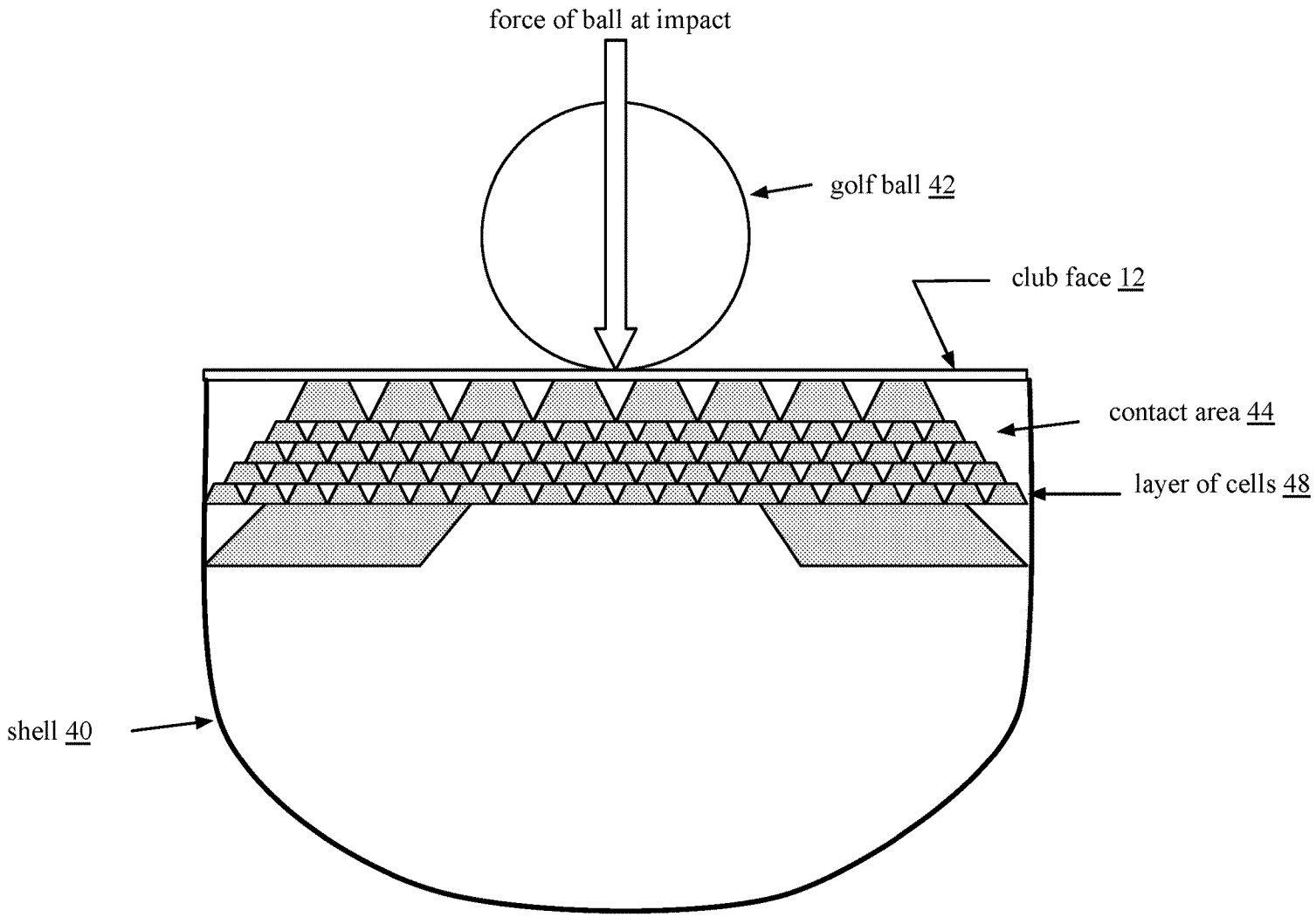
FIG. 20 is a face view diagram of another embodiment of layers of force focusing cells forming a contact area of a golf club head in accordance with the present invention.

FIG. 20 is a face view diagram of another embodiment of a golf club head 10 that includes the club face 12, the shell 40, and the contact area 44. The contact area 44 includes a plurality of layers 48 of force focusing cells. In an embodiment, the force focusing cells of the layers are of different sizes and the last layer include perimeter force focusing cells that are weighted.

As may be used herein, the terms "substantially" and "approximately" provides an industry-accepted tolerance for its corresponding term and/or relativity between items. For some industries, an industry-accepted tolerance is less than one percent and, for other industries, the industry-accepted tolerance is 10 percent or more. Other examples of industry-accepted tolerance range from less than one percent to fifty percent. Industry-accepted tolerances correspond to, but are not limited to, component values, integrated circuit process variations, temperature variations, rise and fall times, thermal noise, dimensions, signaling errors, dropped packets, temperatures, pressures, material compositions, and/or performance metrics. Within an industry, tolerance variances of accepted tolerances may be more or less than a percentage level (e.g., dimension tolerance of less than +/−1%). Some relativity between items may range from a difference of less than a percentage level to a few percent. Other relativity between items may range from a difference of a few percent to magnitude of differences.

As may also be used herein, the term(s) "configured to", "operably coupled to", "coupled to", and/or "coupling" includes direct coupling between items and/or indirect coupling between items via an intervening item (e.g., an item includes, but is not limited to, a component, an element, a circuit, and/or a module) where, for an example of indirect coupling, the intervening item does not modify the information of a signal but may adjust its current level, voltage level, and/or power level. As may further be used herein, inferred coupling (i.e., where one element is coupled to another element by inference) includes direct and indirect coupling between two items in the same manner as "coupled to".

As may even further be used herein, the term "configured to", "operable to", "coupled to", or "operably coupled to" indicates that an item includes one or more of power connections, input(s), output(s), etc., to perform, when activated, one or more its corresponding functions and may further include inferred coupling to one or more other items. As may still further be used herein, the term "associated with", includes direct and/or indirect coupling of separate items and/or one item being embedded within another item.

As may be used herein, the term "compares favorably", indicates that a comparison between two or more items, signals, etc., provides a desired relationship. For example, when the desired relationship is that signal 1 has a greater magnitude than signal 2, a favorable comparison may be achieved when the magnitude of signal 1 is greater than that of signal 2 or when the magnitude of signal 2 is less than that of signal 1. As may be used herein, the term "compares unfavorably", indicates that a comparison between two or more items, signals, etc., fails to provide the desired relationship.

As may be used herein, one or more claims may include, in a specific form of this generic form, the phrase "at least one of a, b, and c" or of this generic form "at least one of a, b, or c", with more or less elements than "a", "b", and "c". In either phrasing, the phrases are to be interpreted identically. In particular, "at least one of a, b, and c" is equivalent to "at least one of a, b, or c" and shall mean a, b, and/or c. As an example, it means: "a" only, "b" only, "c" only, "a" and "b", "a" and "c", "b" and "c", and/or "a", "b", and "c".

One or more embodiments have been described above with the aid of method steps illustrating the performance of specified functions and relationships thereof. The boundaries and sequence of these functional building blocks and method steps have been arbitrarily defined herein for convenience of description. Alternate boundaries and sequences can be defined so long as the specified functions and relationships are appropriately performed. Any such alternate boundaries or sequences are thus within the scope and spirit of the claims. Further, the boundaries of these functional building blocks have been arbitrarily defined for convenience of description. Alternate boundaries could be defined as long as the certain significant functions are appropriately performed. Similarly, flow diagram blocks may also have been arbitrarily defined herein to illustrate certain significant functionality.

To the extent used, the flow diagram block boundaries and sequence could have been defined otherwise and still perform the certain significant functionality. Such alternate definitions of both functional building blocks and flow diagram blocks and sequences are thus within the scope and spirit of the claims. One of average skill in the art will also recognize that the functional building blocks, and other illustrative blocks, modules and components herein, can be implemented as illustrated or by discrete components, application specific integrated circuits, processors executing appropriate software and the like or any combination thereof.

In addition, a flow diagram may include a "start" and/or "continue" indication. The "start" and "continue" indications reflect that the steps presented can optionally be incorporated in or otherwise used in conjunction with one or more other routines. In addition, a flow diagram may include an "end" and/or "continue" indication. The "end" and/or "continue" indications reflect that the steps presented can end as described and shown or optionally be incorporated in or otherwise used in conjunction with one or more other routines. In this context, "start" indicates the beginning of the first step presented and may be preceded by other activities not specifically shown. Further, the "continue" indication reflects that the steps presented may be performed multiple times and/or may be succeeded by other activities not specifically shown. Further, while a flow diagram indicates a particular ordering of steps, other orderings are likewise possible provided that the principles of causality are maintained.

The one or more embodiments are used herein to illustrate one or more aspects, one or more features, one or more concepts, and/or one or more examples. A physical embodiment of an apparatus, an article of manufacture, a machine, and/or of a process may include one or more of the aspects, features, concepts, examples, etc. described with reference to one or more of the embodiments discussed herein. Further, from figure to figure, the embodiments may incorporate the same or similarly named functions, steps, modules, etc. that may use the same or different reference numbers and, as such, the functions, steps, modules, etc. may be the same or similar functions, steps, modules, etc. or different ones.

While particular combinations of various functions and features of the one or more embodiments have been expressly described herein, other combinations of these features and functions are likewise possible. The present disclosure is not limited by the particular examples disclosed herein and expressly incorporates these other combinations.

What is claimed is:

1. A golf club comprises:

a shaft;

a grip coupled to a first end of the shaft; and a club head coupled to a second end of the shaft, wherein the club head includes:

a substantially rigid shell that includes a toe area, a heel area, a sole area, a top area, and a back area;

a club face mechanically coupled to the substantially rigid shell to provide a face of the club head, wherein a first distance from an edge of the toe area to a second edge of the heel area is greater than a second distance from a third edge of the face to a fourth edge of the back area and wherein the club face has a club face surface area; and a contact area positioned proximal to the club face and to the substantially rigid shell, wherein the contact area includes at least two force-focusing layers that concentrate impact forces of the club head towards a first area of the club face surface area, wherein a support layer is juxtaposed between a first and second force-focusing layers of the at least two force-focusing layers, wherein the at least two force-focusing layers comprise a first layer that includes a first plurality of force-focusing cells and a second layer that includes a second plurality of force-focusing cells, wherein the second layer is behind the first layer with respect to the club face.

2. The golf club of claim 1 further comprises:

the second plurality of force-focusing cells including a first set of force-focusing cells and a second set of force-focusing cells, wherein a first force-focusing cell of the first set of force-focusing cells has a first weight, wherein a second force-focusing cell of the second set of force-focusing cells has a second weight, wherein the second weight is greater than the first weight, wherein the first force-focusing cell is in a middle area of the second plurality of force-focusing cells, and wherein the second force-focusing cell is in a perimeter area of the second plurality of force-focusing cells.

3. The golf club of claim 1, wherein a force-focusing cell of the first or the second plurality of force-focusing cells comprises:

a first area;

a second area; and an angled sidewall section coupled to the first area and to the second area to form a geometric shape, wherein a first end of the angled sidewall section is coupled to the first area and an end of the angled sidewall section is coupled to the second area, wherein the second area is larger than the first area, and wherein, when the club face that makes contact with the golf ball, the force-focusing cell substantially retains the geometric shape.

4. The golf club of claim 1 further comprises:

the first layer including a first plurality of interconnected force-focusing cells as the first plurality of force-focusing cells; and the second layer including a first plurality of interconnected force-focusing cells as the second plurality of force-focusing cells.

5. The golf club of claim 1 further comprises:

the first layer including a first plurality of independent force-focusing cells as the first plurality of force-focusing cells; and the second layer including a first plurality of independent force-focusing cells as the second plurality of force-focusing cells.

6. The golf club of claim 1 further comprises:

a first force-focusing cell of the first plurality of force-focusing cells having a first size; and a second force-focusing cell of the second plurality of force-focusing cells having a second size, wherein the second size is larger than the first size.

7. The golf club of claim 1, wherein the club head comprises one of:

a driver club head;

a fairway wood club head;

a hybrid club head; or an iron club head.

8. The golf club of claim 1, wherein the club head comprises:

a contact area backing mechanically coupled to the substantially rigid shell, wherein the contact area backing provides a substantially rigid surface for a layer of the at least two one force-focusing layers.

9. A clubhead comprises:

a substantially rigid shell that includes a toe area, a heel area, a sole area, a top area, and a back area;

a club face mechanically coupled to the substantially rigid shell to provide a face of the clubhead, wherein a first distance from an edge of the toe area to a second edge of the heel area is greater than a second distance from a third edge of the face to a fourth edge of the back area, and wherein the club face has a club face surface area; and a contact area positioned proximal to the club face and to the substantially rigid shell, wherein the contact area includes at least two force-focusing layers that concentrate impact forces of the club head towards a first area of the club face surface area, wherein a support layer is juxtaposed between a first and second force-focusing layers of the at least two force-focusing layers, wherein the at least two force-focusing layers comprise a first layer that includes a first plurality of force-focusing cells and a second layer that includes a second plurality of force-focusing cells, wherein the second layer is behind the first layer with respect to the club face.

10. The clubhead of claim 9 further comprises:

the second plurality of force-focusing cells including a first set of force-focusing cells and a second set of force-focusing cells, wherein a first force-focusing cell of the first set of force-focusing cells has a first weight, wherein a second force-focusing cell of the second set of force-focusing cells has a second weight, wherein the second weight is greater than the first weight, wherein the first force-focusing cell is in a middle area of the second plurality of force-focusing cells, and wherein the second force-focusing cell is in a perimeter area of the second plurality of force-focusing cells.

11. The clubhead of claim 9, wherein a force-focusing cell of the first or the second plurality of force-focusing cells comprises:

a first area;

a second area; and an angled sidewall section coupled to the first area and to the second area to form a geometric shape, wherein a first end of the angled sidewall section is coupled to the first area and an end of the angled sidewall section is coupled to the second area, wherein the second area is larger than the first area, and wherein, when the club face that makes contact with the golf ball, the force-focusing cell substantially retains the geometric shape.

12. The clubhead of claim 9 further comprises:

the first layer including a first plurality of interconnected force-focusing cell as the first plurality of force-focusing cells; and the second layer including a first plurality of interconnected force-focusing cell as the second plurality of force-focusing cells.

13. The clubhead of claim 9 further comprises:

the first layer including a first plurality of independent force-focusing cell as the first plurality of force-focusing cells; and the second layer including a first plurality of independent force-focusing cell as the second plurality of force-focusing cells.

14. The clubhead of claim 9 further comprises:

a first force-focusing cell of the first plurality of force-focusing cells having a first size; and a second force-focusing cell of the second plurality of force-focusing cells having a second size, wherein the second size is larger than the first size.

15. The clubhead of claim 9 further comprises:

a contact area backing mechanically coupled to the substantially rigid shell, wherein the contact area backing provides a substantially rigid surface for the at least one force-focusing layer.

* * * * *